US007195409B2

(12) United States Patent
Horii et al.

(10) Patent No.: US 7,195,409 B2
(45) Date of Patent: Mar. 27, 2007

(54) APPARATUS, METHOD AND PROGRAM FOR PRODUCING SMALL PRINTS

(75) Inventors: Nobuyuki Horii, Tokyo (JP); Ko Kojima, Tokyo (JP); Takanobu Kameda, Tokyo (JP); Yoichi Hine, Tokyo (JP); Tomoyuki Ichikawa, Tokyo (JP); Sumio Honda, Tokyo (JP); Toshinori Nojima, Tokyo (JP); Aiko Tanaka, Tokyo (JP); Takashi Yamaguchi, Tokyo (JP)

(73) Assignee: King Jim Co., Ltd., Tokyo (JP)

( * ) Notice: Subject to any disclaimer, the term of this patent is extended or adjusted under 35 U.S.C. 154(b) by 221 days.

(21) Appl. No.: 10/917,442

(22) Filed: Aug. 13, 2004

(65) Prior Publication Data

US 2005/0058485 A1 Mar. 17, 2005

(30) Foreign Application Priority Data

Aug. 27, 2003 (JP) ..... 2003-303055
Apr. 28, 2004 (JP) ..... 2004-133845
Jul. 12, 2004 (JP) ..... 2004-204959

(51) Int. Cl.
*B41J 11/44* (2006.01)

(52) U.S. Cl. ..... 400/76; 400/109; 400/484; 345/171

(58) Field of Classification Search ..... 400/76, 400/109, 472, 484; 341/22; 345/168, 171
See application file for complete search history.

(56) References Cited

U.S. PATENT DOCUMENTS 4,821,230 A * 4/1989 Kumano et al. ..... 704/6
5,349,368 A * 9/1994 Takeda et al. ..... 345/684
5,659,765 A * 8/1997 Nii ..... 704/4
6,146,034 A * 11/2000 Watanabe et al. ..... 400/615.2
6,345,244 B1 * 2/2002 Clark ..... 704/2
6,384,922 B1 * 5/2002 Hayama et al. ..... 358/1.13
6,473,728 B1 * 10/2002 Tognazzini ..... 704/3
6,523,000 B1 * 2/2003 Ando et al. ..... 704/2
6,799,914 B2 * 10/2004 Eo et al. ..... 400/484
6,823,084 B2 * 11/2004 Myers et al. ..... 382/187
6,890,113 B2 * 5/2005 Block ..... 400/615.2
2003/0200078 A1 * 10/2003 Luo et al. ..... 704/2
2003/0202683 A1 * 10/2003 Ma et al. ..... 382/104
2004/0205671 A1 * 10/2004 Sukehiro et al. ..... 715/532
2005/0180632 A1 * 8/2005 Aradhye et al. ..... 382/182

FOREIGN PATENT DOCUMENTS

JP 06-115167 4/1997
JP 09-109470 4/1997
JP 2002-096524 4/2002

* cited by examiner

*Primary Examiner*—Andrew H. Hirshfeld
*Assistant Examiner*—Dave A. Ghatt
(74) *Attorney, Agent, or Firm*—Bacon & Thomas, PLLC

(57) ABSTRACT

An apparatus, method and program produce small print including character string information in a plurality of languages together with a logo. A language converting function converts an input character string into another language. A multi-language printing function converts the input character string into a specified number and types of languages. A layout function allows specifying one piece of information of the logo, specifying one record, specifying one type of character string information and printing the specified layout as the small print inclusive of the logo and character string.

8 Claims, 19 Drawing Sheets

FIG.4

22c

| LANGUAGE / CATEGORY | JAPANESE | ENGLISH | GERMAN | FRENCH |
|---|---|---|---|---|
| SEASONING (22c1) | SATOU | SUGAR | ZUCKER | SUCRE (22c2) |
| | ⋮ | ⋮ | ⋮ | ⋮ |
| PLACE | IRIGUTI | ENTRANCE | EINGANG | ENTRÉE |
| | ⋮ | ⋮ | ⋮ | ⋮ |
| ATTENTION | KIKEN | DANGER | GEFAHR | DANGER |
| | ⋮ | ⋮ | ⋮ | ⋮ |

22e

| No. | 22e-1 LOGO | 22e-2 JAPANESE | 22e-3 ENGLISH | 22e-4 CHINESE (SIMPLIFIED CHINESE) | 22e-5 CHINESE (TRADITIONAL CHINESE) | 22e-6 KOREAN |
|---|---|---|---|---|---|---|
| 1 |  | HIJOUGUTI | EMERGENCY EXIT | ○○ | ○○ | ○○ |

| 22e-7 CONTACT ADDRESS | 22e-8 COMMENTARY INFORMATION | 22e-9 SOUND CODE | 22e-10 CATEGORY | 22e-11 COLOR CORRESPONDENCE INFORMATION |
|---|---|---|---|---|
| ○○ | ○○ | ○○ | ○○ | ○○ |

22eL

| No. | LOGO (22e-1) | CATEGORY (22e-10) | COLOR CORRESPONDENCE INFORMATION (22e-11) |
|---|---|---|---|
| 1 |  | ○○ | ○○ |
| | | | |

22eC

| No. | JAPANESE (22e-2) | ENGLISH (22e-3) | CHINESE (SIMPLIFIED CHINESE) (22e-4) | CHINESE (TRADITIONAL CHINESE) (22e-5) | KOREAN (22e-6) |
|---|---|---|---|---|---|
| 1 | HIJOUGUTI | EMERGENCY EXIT | ○○ | ○○ | ○○ |
| | | | | | |

| CONTACT ADDRESS (22e-7) | COMMENTARY INFORMATION (22e-8) | SOUND CODE (22e-9) | CATEGORY (22e-10) |
|---|---|---|---|
| ○○ | ○○ | ○○ | ○○ |
| | | | |

FIG.20

| | JAPANESE | | ENGLISH | | GERMAN | | FRENCH | |
|---|---|---|---|---|---|---|---|---|
| | READING | WORD | READING | WORD | READING | WORD | READING | WORD |
| SEASONING | SATOU | SATOU | SYUGA- | SUGAR | ZUKKA- | ZUCKER | SYUKURE | SUCRE |
| | ..... | ..... | ..... | ..... | ..... | ..... | ..... | ..... |

APPARATUS, METHOD AND PROGRAM FOR PRODUCING SMALL PRINTS

CROSS-REFERENCE TO RELATED APPLICATIONS

The present application claims the benefit of priority of Japanese Patent Application No. 2003-303055 filed Aug. 27, 2003, Japanese Patent Application No. 2004-133845 filed Apr. 28, 2004 and Japanese Patent Application No. 2004-204959 filed Jul. 12, 2004, the subject matter of which is hereby incorporated by reference.

BACKGROUND OF THE INVENTION

1. Field of the Invention

The present invention relates to an apparatus, method, and program for producing small prints. For example, the invention can be applied to a dedicated tape printing apparatus, a tape printing system in which a personal computer and a label printer are integrated, a dedicated stamp (seal) producing apparatus, and a stamp producing system in which the personal computer and a peripheral apparatus for producing the stamp are integrated, and the like.

2. Description of the Related Art

For example, the dedicated tape printing apparatus prints a string of inputted characters (it is assumed that the character string is a concept including a symbol, a pictograph, an outer frame, and a background pattern) in a continuous tape according to need, and discharges and cuts the printed tape. The post-cutting tape in which the character string is printed is referred to as label.

As the tape printing apparatus becomes widespread, the application of the label is increased and various people use the tape printing apparatus. For example, in public places such as a railroad station and sightseeing site where many people come and go, the label is used rather than a marking plate in order to indicate a toilet or an emergency exit. In the label used for the public place, it is preferable to use a pictogram, the pictograph, or the logo (hereinafter these are collectively referred to as logo) in which a public mark is applied in order to recognize contents of a notation regardless of age, sex, or nationality. However, in the conventional tape printing apparatus, an external character registration function is often required in order to print the logo such as the public mark on the label (for the external character registration function, see Japanese Patent Application Laid-Open No. 6-115167).

It is preferable that the label having various languages is bonded in the place where people of diverse nationalities come and go. When the tape printing apparatus for Japanese, the tape printing apparatus for German, and the like are individually prepared, such demands can be satisfied. However, since it is necessary to prepare many apparatuses, it is not realistic as the method of corresponding to the plurality of languages.

In the conventional tape printing apparatus, there is the tape printing apparatus which can input the English character in addition to the Japanese character, and the user can input a notation in both languages to add the notation in both languages to the label. Japanese Patent Application Laid-Open No. 9-109470 proposes a tape printing apparatus having a function of producing the label such that a vocabulary notebook in which the Japanese character strings are printed in one surface and the corresponding English character strings are printed in the other surface can be produced by inputting the Japanese character string is inputted to instruct the printing after a vocabulary notebook producing mode is instructed, when the printed label is folded in the center to adhere to each other.

However, in the conventional apparatus described in Japanese Patent Application Laid-Open No. 9-109470, translation information (English-Japanese dictionary, Japanese-English dictionary, and the like) which can produce the vocabulary notebook is not utilized as other functions, so that the conventional apparatus does not achieve high cost performance. Namely, a user can utilize the translation dictionary only as the production of the vocabulary notebook.

Further, in the case where the conventional apparatus has a function of registering an external character of a logo such as a public mark, it takes a long time to produce the label including the logo such as the public mark.

There are a few conventional tape printing apparatuses in which some of the logos such as the public mark are prepared as the symbol, however, those apparatuses have the following problem. Even if the logo such as the public mark is applied, sometimes it is useful to print the character string with the logo. For example, in the case where a recognition rate of a certain logo differs among countries, it is preferable to print complimentarily the character string of the language of the country in which the recognition rate is low. However, since character types are limited in the conventional tape printing apparatus, it is difficult to print the character string with the logo. Even if the character string can be inputted in the desired language, it is necessary to perform a logo selection operation and a character string input operation which is independent of the logo selection operation, so that a long time is required for the operation of the production of the label.

SUMMARY OF THE INVENTION

It is an object of the invention to provide the apparatus, method and program for producing the small prints, in which the function of utilizing translation information is enriched to enhance user's usability.

It is another object of the invention to provide the apparatus, method and program for producing the small prints, in which the small print having print contents including the logo such as the public mark can be easily produced and user's usability is enhanced.

A small print producing apparatus of the invention comprises (1) translating means for converting the character string into the character string of another language, (2) character string capturing means for capturing the character string in the predetermined language, (3) language conversion starting means for starting a process of the translating means, the process of the translating means converting the character string in the predetermined language captured by the character string capturing means into the character string of another language, and (4) character string converting means for including the character string of the post-conversion obtained by the translating means in the character string of a printing subject and not including the character string in the predetermined language captured by the character string capturing means in the character string of the printing subject.

A small print producing apparatus of the invention comprises (1) translating means for converting the character string into the character string of one or a plurality of other languages, (2) character string capturing means for capturing the character string in a predetermined language, (3) multi-language printing starting means for starting a multi-language printing process by the translating means, (4) multi-language printing language information capturing means for capturing the number of languages and a type of language of the corresponding character string printed in the print medium, (5) multi-language printing character string capturing means for starting the translating means to capture the character string corresponding to character string in the predetermined language captured by the character string capturing means according to the number of languages and the type of language captured by the multi-language printing language information capturing means, and (6) multi-language printing means for including the character strings of the plurality of languages obtained by the multi-language printing character string capturing means in the character string of a printing subject.

A small print producing apparatus of the invention comprises (1) first storage means for storing information on a plurality of logos, (2) second storage means for storing a plurality of records including information on a plurality of types of fields including the fields of at least two types of languages, (3) layout capturing means for specifying a layout of print elements in a small print to be produced during instruction of production of the small print in which the logo and the character string are mixed together, (4) print element capturing means for specifying one pieces of information on the logo as the print element from the plurality of pieces of information of the logo stored in the first storage means, specifying at least one record from the plurality of records stored in the second storage means, and specifying information of one or the plurality of types of fields as the print element from the specified records during instruction of production of the small print in which the logo and the character string are mixed together, and (5) printing means for printing the information of the print elements specified by the print element capturing means to produce the small print in accordance with the layout specified by the layout capturing means.

A small print producing method of the invention comprises (1) a translating step for converting the character string into the character string of another language, (2) a character string capturing step for capturing the character string in the predetermined language, (3) a language conversion starting step for starting a process of the translating step, the process of the translating step converting the character string in the predetermined language captured by the character string capturing step into the character string of another language, and (4) a character string converting step for including the character string of the post-conversion obtained by the translating step in the character string of a printing subject and not including the character string in the predetermined language captured by the character string capturing step in the character string of the printing subject.

A small print producing method of the invention comprises (1) a translating step for converting the character string into the character string of one or a plurality of other languages, (2) a character string capturing step for capturing the character string in a predetermined language, (3) a multi-language printing starting step for starting a multi-language printing process by the translating step, (4) a multi-language printing language information capturing step for capturing the number of languages and a type of language of the corresponding character string printed in the print medium, (5) a multi-language printing character string capturing step for starting the translating step to capture the character string corresponding to character string in the predetermined language captured by the character string capturing step according to the number of languages and the type of language captured by the multi-language printing language information capturing step, and (6) a multi-language printing step for including the character strings of the plurality of languages obtained by the multi-language printing character string capturing step in the character string of a printing subject.

A small print producing method of the invention comprises (1) a step of preparing previously first storage means for storing information on a plurality of logos and second storage means for storing a plurality of records including information on a plurality of types of fields including the fields of at least two types of languages, (2) a layout capturing step for specifying a layout of print elements in a small print to be produced during instruction of production of the small print in which the logo and the character string are mixed together, (3) a print element capturing step for specifying one pieces of information on the logo as the print element from the plurality of pieces of information of the logo stored in the first storage means, specifying at least one record from the plurality of records stored in the second storage means, and specifying information of one or the plurality of types of fields as the print element from the specified records during instruction of production of the small print in which the logo and the character string are mixed together, and (4) a printing step for printing the information of the print elements specified by the print element capturing step to produce the small print in accordance with the layout specified by the layout capturing step.

A small print producing program of the invention is described by code with which a computer can execute each step of a small print producing method of the invention and storage data.

BRIEF DESCRIPTION OF THE DRAWINGS

FIG. 4 is an explanatory view showing the configuration of a translation dictionary of the tape printing system of the first embodiment;

FIG. 20 is an explanatory view showing the configuration of the translation dictionary in another embodiment which modifies the first or second embodiment;

DETAILED DESCRIPTION OF THE PREFERRED EMBODIMENTS

(A) First Embodiment

A first embodiment in which the apparatus, method, and program for producing the small prints of the invention are applied to the system, method, and program for printing the tape will be described in detail below referring to the accompanying drawings.

Figure 1:
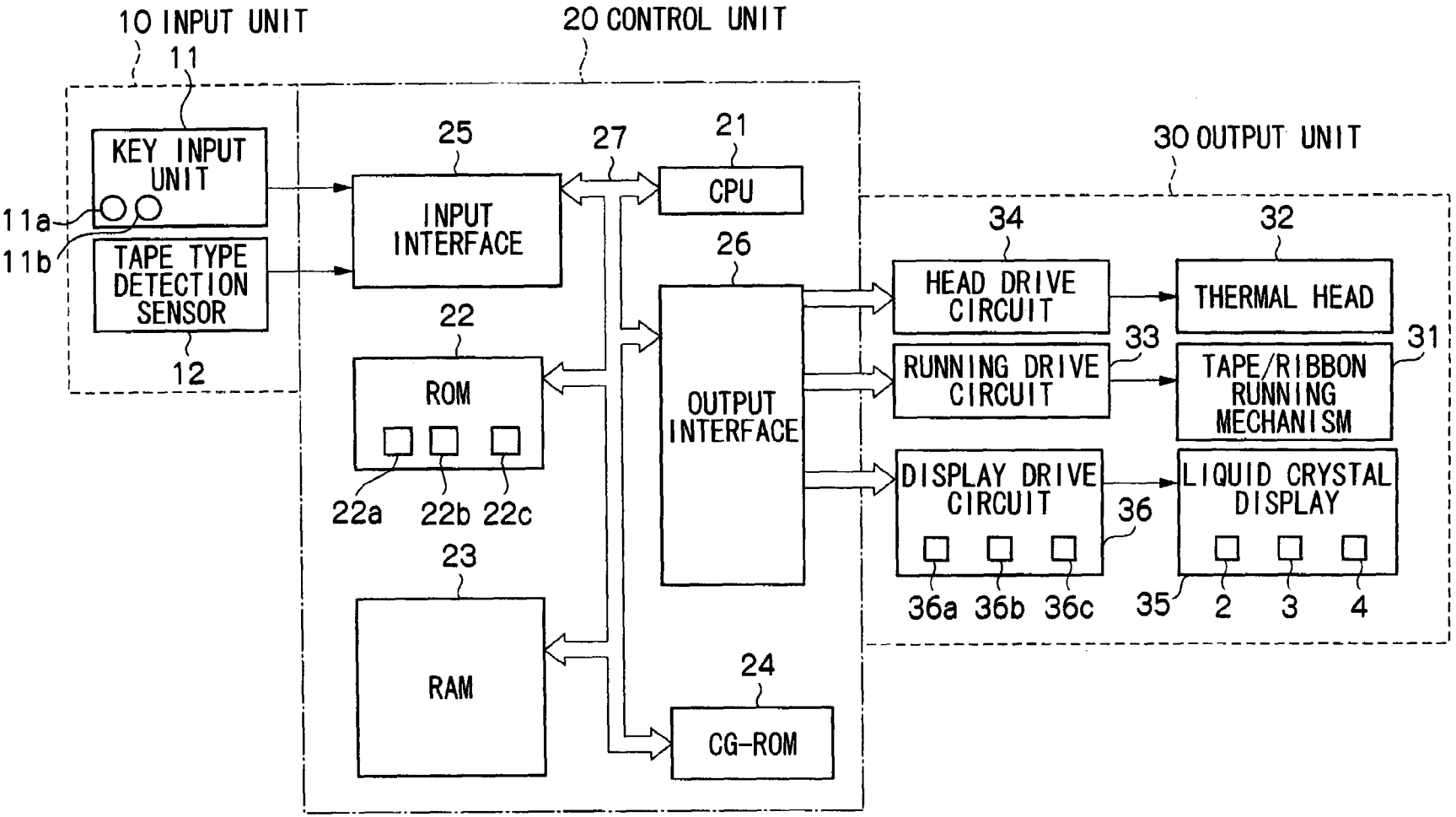
FIG. 1 is a block diagram showing an electrical configuration of a tape printing system of a first embodiment.
Figure 2:
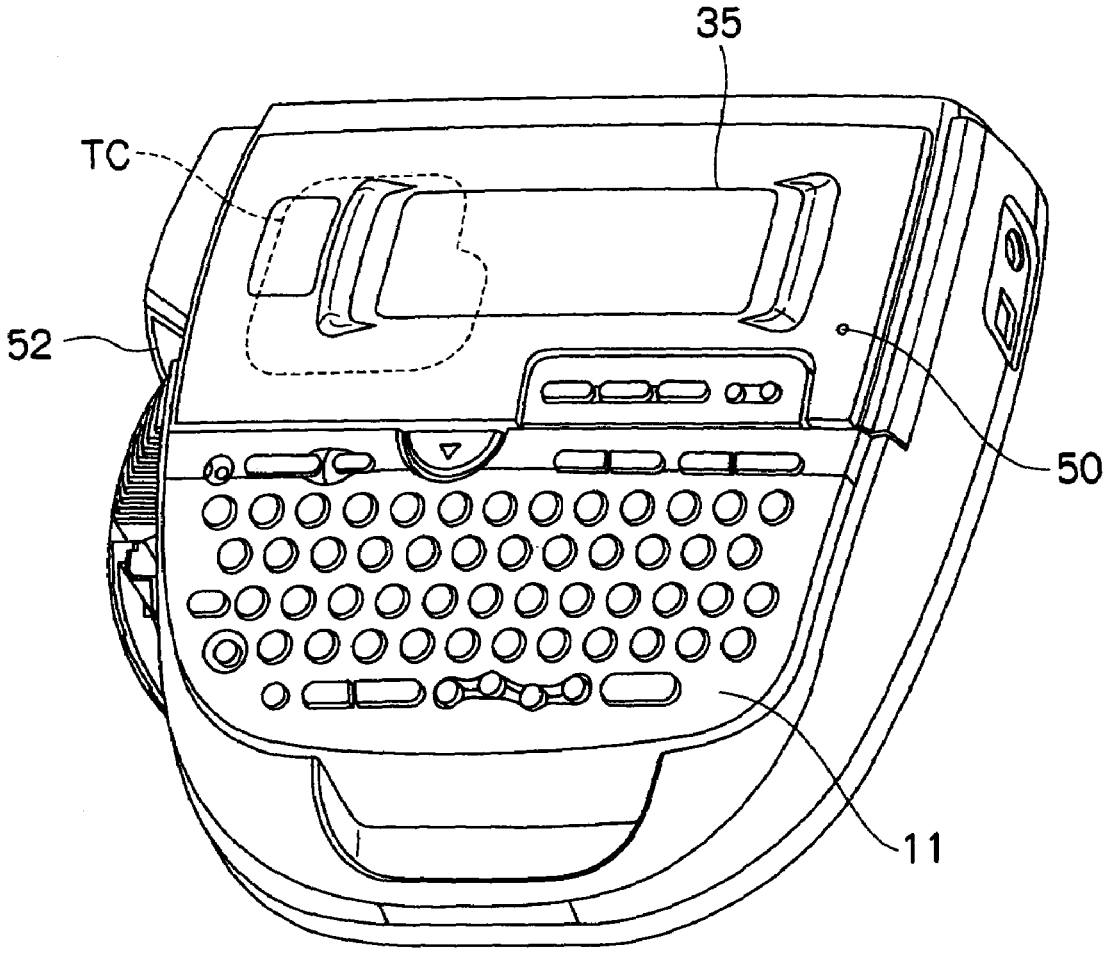
FIG. 2 is a perspective view showing an appearance of the tape printing system of the first embodiment.

FIG. 1 is a block diagram showing an electrical overall configuration of the tape printing system of the first embodiment, and FIG. 2 is a schematic perspective view showing an appearance of the tape printing system. The tape printing system (tape printing apparatus) of the first embodiment is configured as an independent apparatus dedicated to the tape printing.

In FIG. 1, the tape printing system of the first embodiment roughly includes an input unit 10, a control unit 20, and an output unit 30. The control unit 20 performs the processing according to information from the input unit 10 or a processing stage at that time. The output unit 30 outputs the result of the processing onto a display or to the print.

Although the detail description of the configuration of the input unit 10 will be omitted, the input unit 10 includes a key input unit 11 equipped with pressing keys (or dial keys, touch panel and the like) and a tape type detection sensor 12. The key input unit 11 generates character codes and various kinds of control data, which are given to the control unit 20. The tape type detection sensor 12 detects a width of the loaded tape and the like to give tape type information to the control unit 20. The tape is actually stored in a tape cartridge, a physical identification element such as a hole defining the tape width or color is provided in the tape cartridge, and the tape type detection sensor 12 reads the physical identification element to outputs the tape type information. It is possible that the tape type is distinguished only by the tape width, or it is possible that the tape type is distinguished by the color of printing ink, a surface color of the tape, or the like.

In the first embodiment, the key input unit 11 also includes a language converting key 11*a* (it can be a dedicated key or the key which also acts as a function key) which instructs to convert (translate) a Japanese character string into the other language character string (for example, English, German, or French) and a multi-language printing key 11*b* (it can be a dedicated key or the key which also acts as the function key) which simply inputs the character strings corresponding to the plurality of languages.

A cover 50 having a transparent window in FIG. 2 is provided above the apparatus housing in which a tape cassette TC is stored. The tape cassette TC is loaded under the cover 50, and the tape type detection sensor 12 reads the physical identification element of the tape cassette TC which is in the loaded state.

The output unit 30 includes a printing configuration and a display configuration. The printing configuration is one which performs the normal printing to the tape and the display configuration is one which display the input information to be printed in the label or a message of an operational guidance.

A tape ribbon running mechanism 31 including a stepping motor and a direct-current motor as its main constituents feeds the tape or ink ribbon (not shown) which are loaded in the apparatus to a predetermined printing position or the outside of the apparatus. A print head (thermal head in this case) 32 is fixed to the apparatus to perform the printing to the running tape by heat transfer. The tape ribbon running mechanism 31 and the thermal head 32 are driven by a running drive circuit 33 and a head drive circuit 34 under the control of the control unit 20 respectively. Cutting the printed tape is performed by a cutter (not shown) which is driven by, for example, external force from a user or the motor. The printed tape is discharged from an ejection port 52 in FIG. 2, and the cutter (not shown) is provided near the ejection port 52.

A liquid crystal display 35 is provided as a display unit of the tape printing system, and the liquid crystal display 35 is driven by a display drive circuit 36 under the control of the control circuit 20. For example, the liquid crystal display 35 can display the characters having a predetermined size in several lines (for example, four lines) and several columns (for example, 12 characters). In the first embodiment, the liquid crystal display 35 is provided on the cover 50 (see FIG. 2).

Figure 3:
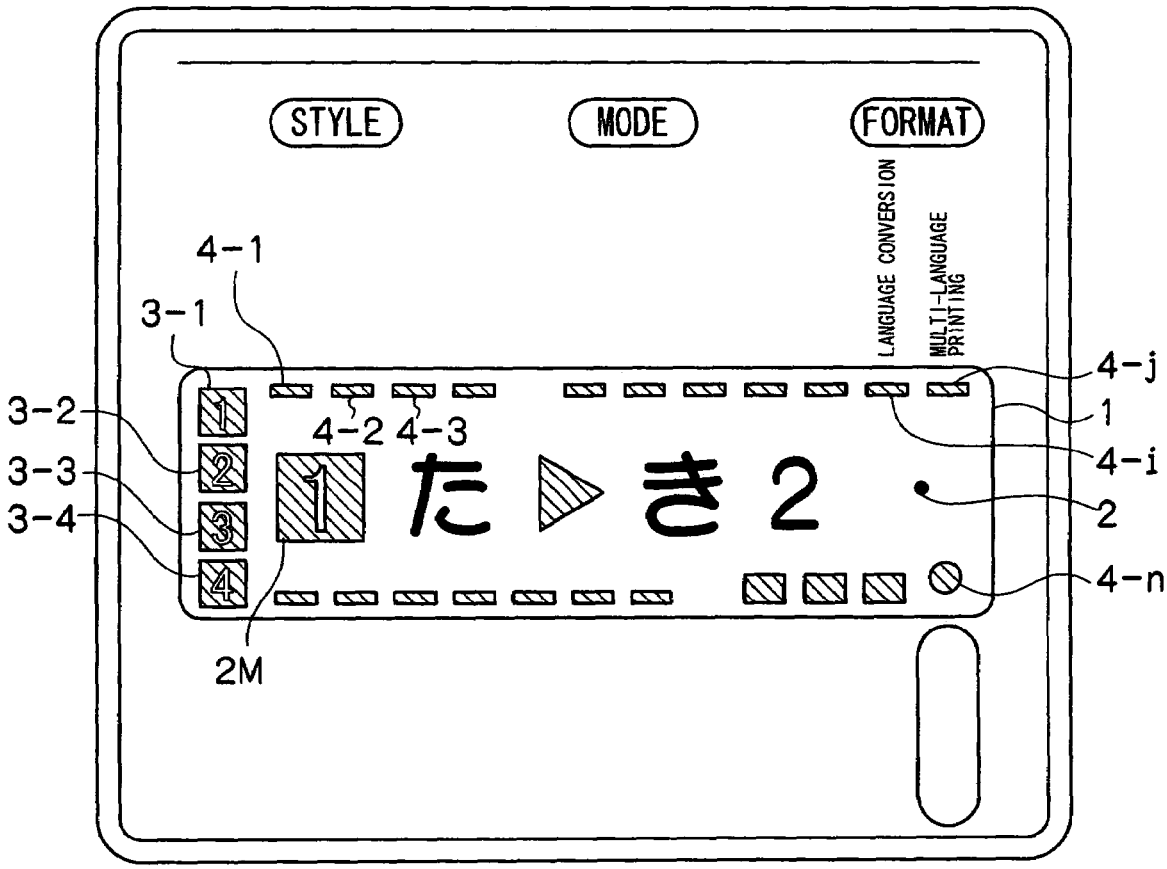
FIG. 3 is a plan view showing a configuration of a display surface of the tape printing system of the first embodiment.

For example, a display surface of the liquid crystal display 35 is configured as shown in FIG. 3. The display surface 1 of the liquid crystal display 35 includes a character display area 2, line number indicators 3-1 to 3-4, and attribute indicators 4-1 to 4-n which indicate various attributes concerning an input character string. In the attribute indicators 4-1 to 4-n, the attribute shown by the characters corresponding to the attribute indicators 4-1 to 4-n and described in the periphery of the display surface 1 is adopted, when the attribute indicator in the attribute indicators 4-1 to 4-n is turned on. The attributes indicated by the attribute indicators 4-1 to 4-n include the size of the character, input method such as Kana character input or Roman character input, a unit of a certain amount of characters such as vertical writing or central justification, a character unit such as decorative characters, or alphabetic characters, and the indication whether a basic format is adopted or not.

In the first embodiment, the indication whether the status is in a language converting mode or not (4-i) and the indication whether the status is in a multi-language printing mode or not (4-j) are also included in the attributes indicated by the attribute indicators 4-1 to 4-n.

Since the liquid crystal display 35 includes the character display area 2, the line number indicator unit 3 (3-1 to 3-4), and the attribute indicator unit 4 (4-1 to 4-n), the display drive circuit 36 also roughly includes a drive unit 36*a* corresponding to the character display area 2, a drive unit 36*b* corresponding to the line number indicator unit 3 (3-1 to 3-4), and a drive unit 36*c* corresponding to the attribute indicator unit 4 (4-1 to 4-n).

For example, the control unit 20 is formed by a microcomputer. CPU 21, ROM 22, RAM 23, the character generator ROM (CG-ROM) 24, the input interface 25 and the output interface 26 are connected one another through the system bus 27 to construct the control unit 20.

ROM 22 includes one or more of ROM chips. Various processing programs and the fixed data such as dictionary data for Kana-Kanji conversion are stored in ROM 22. For example, a program of executing the language converting mode (hereinafter properly referred to as language converting program) 22*a*, a program of executing the multi-language printing mode (hereinafter properly referred to as multi-language printing program) 22*b*, and a translation dictionary 22*c* which describes the character strings corresponding to the plurality of languages are also stored in ROM 22.

RAM 23 includes one or more of RAM chips and used as a working memory. RAM 23 also includes the fixed data with respect to user input and the like. Although RAM 23 is shown as RAM 23 in FIG. 1, it is assumed that RAM 23 has a broad concept including other memory devices such as EEPROM used as the working memory. RAM 23 has a printing buffer which performs dot expansion and storage of the printed character string, a display buffer in which a display image for the input character string is stored, a text buffer in which the character data concerning the printing and input is stored, a line number indicator status retention buffer which holds a display mode for the line number indicators 3-1 to 3-4, an attribute indicator status retention buffer which holds the display mode for the attribute indicators 4-1 to 4-n.

Dot patterns of the characters and symbols prepared for the tape printing apparatus are stored in CG-ROM 24. When code data specifying the character or the symbol is given, CG-ROM 24 outputs the corresponding dot pattern. It is also possible that CG-ROM for display and CG-ROM for printing are individually provided. It is also possible to be provided each CG-ROM corresponding to the type of language. It is possible that a storage format of font information is either an outline font format or a bit map format.

The input interface 25 interfaces between the input unit 10 and the control unit 20, and the output interface 26 interfaces between the output unit 30 and the control unit 20.

CPU 21 executes the processing program which is stored in ROM 22 and determined in accordance with an input signal from the input unit 10 or a processing stage at that time, while utilizing RAM 23 as the working area or using the fixed data stored in ROM 22 or RAM 23 according to need. CPU 21 causes the liquid crystal display 35 to display the processing status or processing result or causes the printing the processing result in the tape.

FIG. 4 shows an example of the configuration of the translation dictionary 22*c* and examples of the language type includes Japanese, English, German, and French. In the translation dictionary 22*c*, the words are merged in each category to which a category name 22*c*1 is given, and records 22*c*2 including the character strings corresponding to the plurality of languages are described in the category. It is possible that the number of records in the translation dictionary 22*c* is at the same level as a general dictionary, or it is possible to suppress the number of records to a minimum in consideration of usage of the label (the category corresponds to the usage).

For example, "seasoning" is intended to be the label adhering to a cruet containing the seasoning and put on a table in a restaurant which people of diverse nationalities come to, "place" is intended to be the label to recognize the place where people of diverse nationalities come and go and the state of the place, and "caution" is intended to be the label for calling attention to people.

The category can also be hierarchized. For example, it is possible to prepare "seasoning," "alcohols," "tableware," and the like as the lower hierarchy of the upper hierarchy "cooking." When the category is hierarchized, for example "cooking" is selected from the plurality of category names of the upper hierarchy, then "seasoning" of the lower category name is selected, and the word belonging to "seasoning" can be specified.

Then, the action of the tape printing apparatus (tape printing method (small print producing method) of the first embodiment will be described. The action in which the language converting key 11*a* is operated and the action in which the multi-language printing key 11*b* is operated will be sequentially described. These actions are the feature in the input action.

Figure 5:
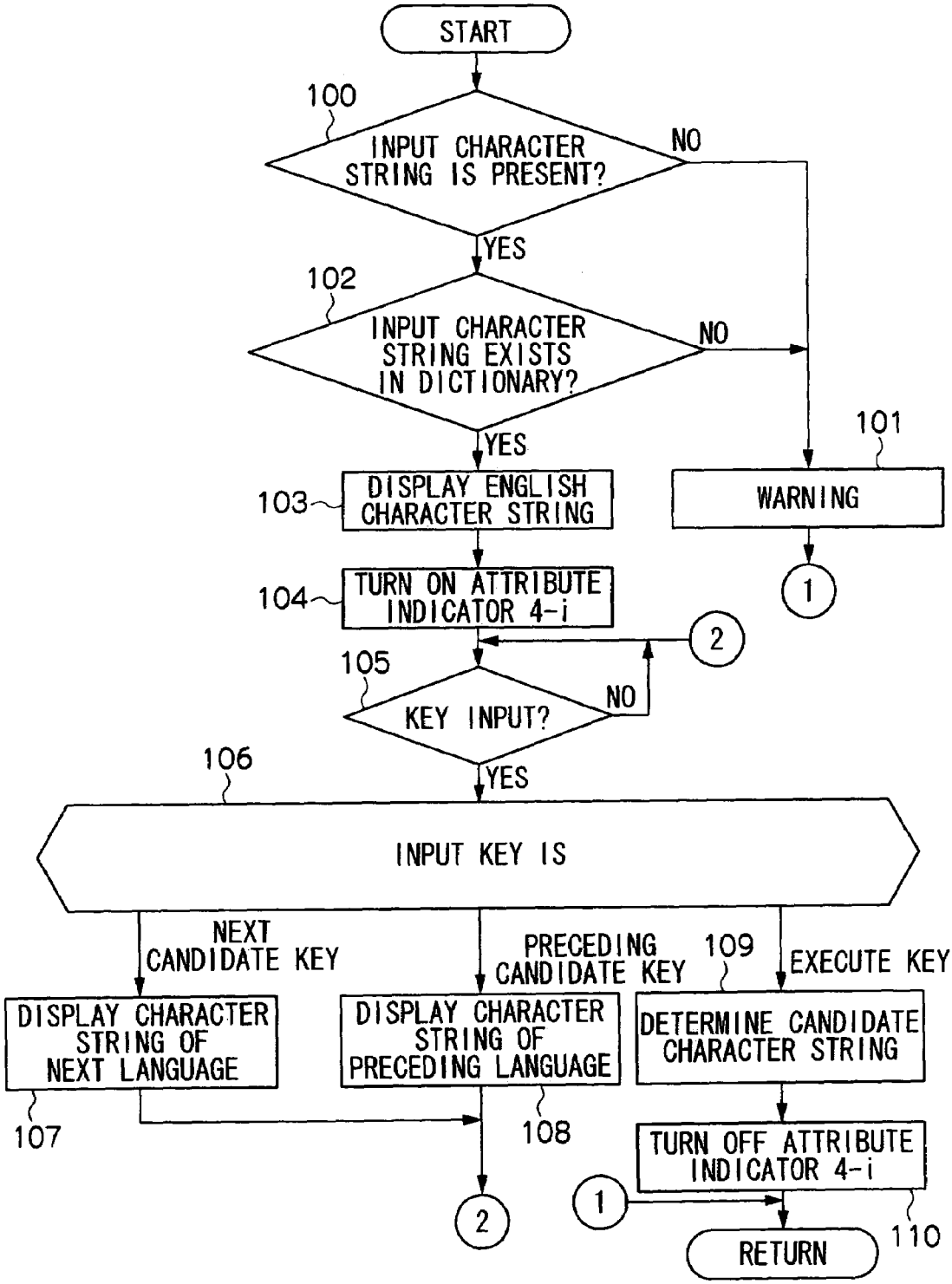
FIG. 5 is a flow chart showing a language converting process of the tape printing system of the first embodiment.

When the language converting key 11*a* is operated, CPU 21 starts the language converting program 22*a* shown by the flow chart of FIG. 5.

CPU 21 determines whether the Japanese character string to be converted has been inputted or not (or whether the Japanese character string to be converted is present or absent) (Step 100). It is possible that the Japanese character string to be converted is a character string of Hiragana or a character string of Katakana which is tentatively determined. It is also possible that the Japanese character string to be converted is the character string of a Kanji character candidate (highlight the whole character string) where a cursor is located during the Kana-Kanji conversion.

When the Japanese character string to be converted is absent, CPU 21 causes a buzzer (not shown) to provide warning sound (Step 101) and ends a series of processes. When the Japanese character string to be converted is present, CPU 21 determines whether or not the record including the Japanese character string exists in the translation dictionary 22*c* (Step 102).

When the appropriate record does not exist in the translation dictionary 22*c*, CPU 21 causes the buzzer (not shown) to provide the warning sound (Step 101) and ends the series of processes. When the appropriate record exists in the translation dictionary 22*c*, CPU 21 retrieves the corresponding English character string from the translation dictionary 22*c* to cause the liquid crystal display 35 to display the English character string as the conversion candidate (Step 103). CPU 21 turns on the attribute indicator 4-i concerning the language conversion (Step 104), and the CPU 21 waits for the key input (Step 105). When the key input is performed, CPU 21 determines the type of key input (Step 106).

At this point, when a next candidate key (for example, a cursor rightward movement key or a cursor downward movement key corresponds to the next candidate key) is operated, CPU 21 retrieves the corresponding character string of the next language from the translation dictionary 22*c* to cause the liquid crystal display 35 to display the character string as the conversion candidate (Step 107) and returns to the stand-by state of the key input. When a previous candidate key (for example, a cursor leftward movement key or a cursor upward movement key corresponds to the previous candidate key) is operated, CPU 21 retrieves the corresponding character string of the previous language from the translation dictionary 22*c* to cause the liquid crystal display 35 to display the character string as the conversion candidate (Step 108) and returns to the stand-by state of the key input.

A forward change sequence of the language candidate is cyclic, for example "Japanese"→"English"→"German"→"French"→"Japanese." When the next candidate key is operated, the conversion candidate is changed along the forward direction and when the previous candidate key is operated, the conversion candidate is changed along the direction opposite to the forward direction.

When an execute key (selection key) is operated in the stand-by state of the key input, while CPU 21 writes the character string of the language displayed on the liquid crystal display 35 in the text area in which the printing character strings are stored as the selected character string, CPU 21 causes the liquid crystal display 35 to display the character string in the determined state (Step 309). Then, CPU 21 turns off the attribute indicator 4-i concerning the language conversion (Step 110), and returns to the main routine.

Although the description is omitted in FIG. 5, CPU 21 returns the whole of apparatus to the state immediately preceding the state in which the language converting key 11*a* is operated, when a cancel key (for example, a delete key corresponds to the cancel key) is operated.

Even if the user does not know the expressions in English, German, or French, the user can input the different language character string by inputting the Japanese character string to perform the language conversion, such that the language converting key 11*a* is operated to start the process in the language converting mode after the input of the Japanese character string.

Then, the action in which the multi-language printing key 11*b* is operated will be described referring to the flow chart of FIG. 6. When the multi-language printing key 11*b* is operated, CPU 21 starts the multi-language printing program 22*b* shown by the flow chart of FIG. 6.

CPU 21 decides whether the Japanese character string provided for the multi-language printing has been inputted or not (or whether the Japanese character string provided for the multi-language printing is present or absent) (Step 200). It is possible that the Japanese character string provided for the multi-language printing is the hiragana character string or the katakana character string which is tentatively determined. It is possible that the Japanese character string provided for the multi-language printing is the character string of the kanji character candidate (the whole of highlighted character string) where the cursor is located during the kana-kanji conversion.

When the Japanese character string provided for the multi-language printing is present, CPU 21 decides whether or not the record including the Japanese character string exists in the translation dictionary 22*c* (Step 201). When the appropriate record does not exist in the translation dictionary 22*c*, CPU 21 causes the buzzer (not shown) to provide the warning sound (Step 202) and ends the series of processes. When the appropriate record exists in the translation dictionary 22*c*, CPU 21 causes the liquid crystal display 35 to display the attribute indicator 4-j concerning the multi-language printing (Step 203).

When the Japanese character string provided for the multi-language printing does not exist at the stage in which the multi-language printing key 11*b* has been operated (NO in Step 200), after CPU 21 causes the liquid crystal display 35 to display the attribute indicator 4-j concerning the multi-language printing (Step 204), CPU 21 causes the user to select the desired category from the categories prepared in the translation dictionary 22*c* (Step 205) and causes the user to select the desired Japanese character string from the plurality of Japanese character strings belonging to the selected category (Step 206).

In the selection of the category, CPU 21 causes the liquid crystal display 35 to display the category name prepared in the translation dictionary 22*c* while changing the category names according to the operation of a candidate change key, and CPU 21 captures the category candidate at the time when the execute key is operated assuming that the Japanese character string is selected by the user.

In the selection of the category, CPU 21 causes the liquid crystal display 35 to display the Japanese character string prepared in the translation dictionary 22*c* while changing the category names according to the operation of a candidate change key, and CPU 21 captures the Japanese character string at the time when the execute key is operated assuming that the Japanese character string is selected by the user.

At the stage in which the multi-language printing key 11*b* has been operated, When the Japanese character string is determined independently of the presence of the Japanese character string provided for the multi-language printing and it becomes clear that the Japanese character string exists in the translation dictionary 22*c*, CPU 21 causes the user to select the number of languages printed together (Step 207), causes the user to specify the type of language printed together (Step 208), and causes the user to specify the multi-language printing method (Step 209). It is possible the type of language is specified and then the number of types of the languages is captured as the number of languages at the time when the specification is finished. Namely, it is possible to interchange the process sequence between Step 207 and Step 208. It is also possible that the multi-language printing method (see FIG. 7) is specified before the specification of the type of language, when the number of languages is specified in advance of the specification of the type of language. It is possible to automatically specify the number of languages through specifying the multi-language printing method.

In the first embodiment, since four-language corresponding character strings are stored in the translation dictionary 22*c*, CPU 21 causes the user to select the number of languages printed together by causing the liquid crystal display 35 to display the numbers of "2" to "4" in a menu.

CPU 21 causes the user to select the type of language as the final order and to determine the printing order of the languages while causing the liquid crystal display 35 to display, e.g. four languages of Japanese, English, German, and French in the menu. In the selection of the type of language from the second selected language, it is also possible that the already selected language is not included in the selection menu.

For example, in the case where three languages are printed together, the user can specify the arbitrary order such that English is specified as the first order, Japanese is specified as the second order, and German is specified as the third order, or such that Japanese is specified as the first order, German is specified as the second order, and English is specified as the third order.

In the case where three languages are selected, CPU 21 causes the user to select the multi-language printing method, while the liquid crystal display 35 sequentially changes the display of print image forms (not including the specific character string) shown in FIGS. 7A to 7G in accordance with the operation of the cursor movement key. The multi-language printing method includes various pieces of attribute information such as the character size, a character pitch, and the character justification (the central justification in the case of the vertical multi-language printing as shown in FIGS. 7A to 7D) (numerical information is relative information and converted into absolute information by the loaded tape width).

Figure 7A:
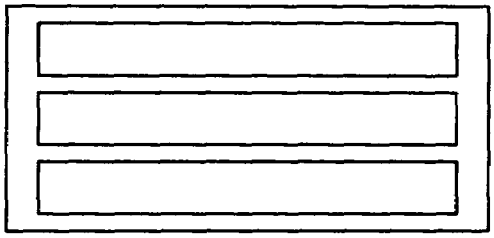
FIG. 7 is an explanatory view of options of a multi-language printing method of the tape printing system of the first embodiment.
Figure 7B:
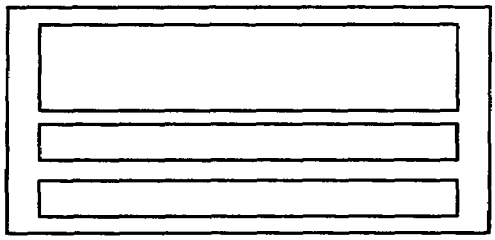
Figure 7C:
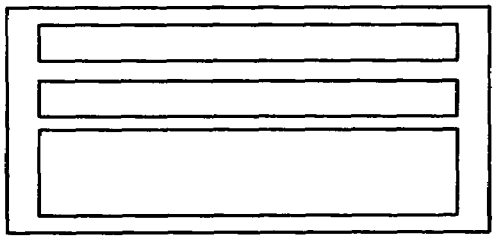
Figure 7D:
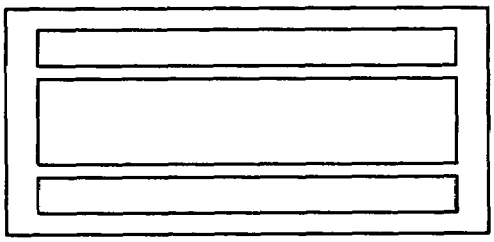
Figure 7E:
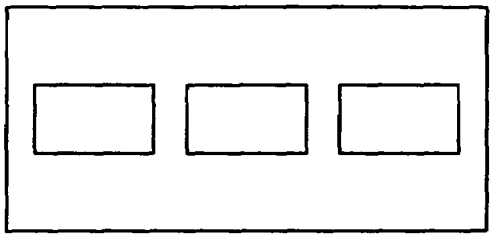
Figure 7F:
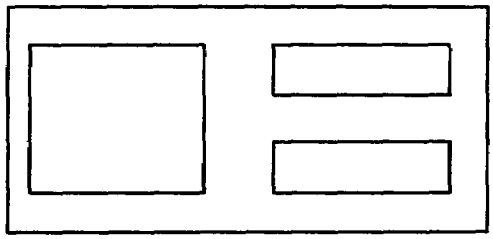
Figure 7G:
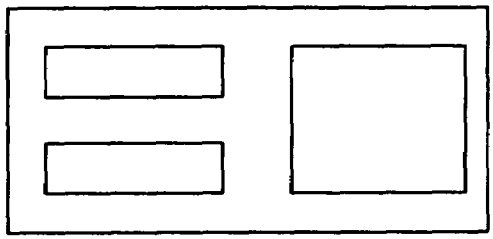

In the vertical multi-language printing method in FIGS. 7A to 7D, the combinations of the character sizes of the three languages are "the same character sizes," "the large, small, and small character sizes," "the small, small, and large character sizes," and "the small, large, and small character sizes" respectively. FIG. 7E shows the multi-language printing method in which three languages are arranged in the lengthwise direction of the tape and the three languages have "the same character size" in the combination. It is also possible that the character sizes of the three languages are different from one another, e.g. the front language character size is larger than other language character sizes. FIG. 7F shows the multi-language printing method in which the three languages are divided into two blocks in the lengthwise direction of the tape, the first language having "the large character size" is arranged in the front block, and the second and third languages vertically separated from each other having "the intermediate character size" are arranged in the rear block. FIG. 7G shows the multi-language printing method in which the three languages are divided into two blocks in the lengthwise direction of the tape, the first and second languages vertically separated from each other having "the intermediate character size" are arranged in the front block, and the third language having "the large character size" is arranged in the rear block.

In the selection of the multi-language printing method, CPU 21 causes the user to specify (1) whether the character defining the type of language is printed or not (it is also possible to include the symbol and a flag) and (2) whether the partially cutting is performed or not.

Figure 8A:
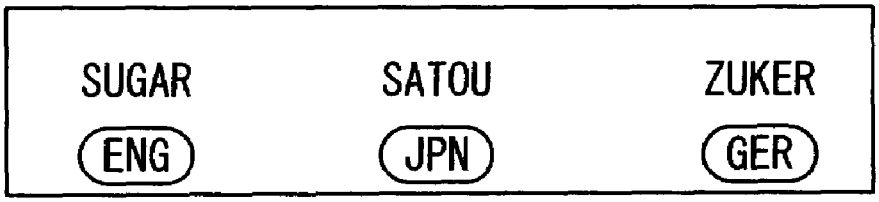
FIG. 8 is an explanatory view of a language type notifying method of the tape printing system of the first embodiment.
Figure 8B:
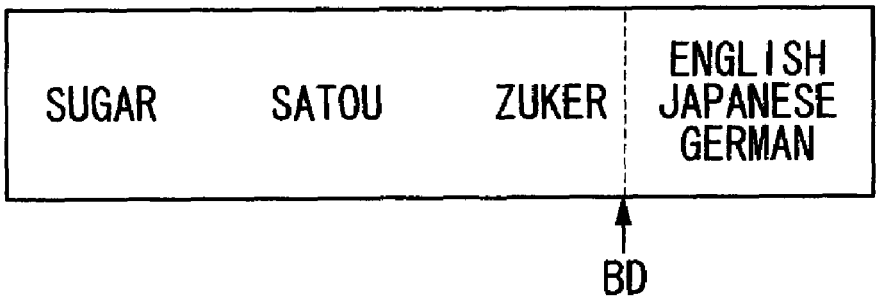

Taking FIG. 7E for instance, "printing the character defining the type of language" will be described. As shown in FIGS. 8A and 8B, "printing the character defining the type of language" means that the type of language of the character string included in the multi-language printing label is also printed. As shown in FIG. 8A, it is possible that a printing position of the character defining the type of language of the character string is located close to the character string of the language. As shown in FIG. 8B, it is possible that the printing position of the character defining the type of language of the character string is located in an independent area where the characters of the type of languages are collected. When the method of printing the characters of the type of languages shown in FIG. 8B is selected, CPU 21 causes the user to select whether the full cut (both a print paper layer of the tape and a release paper layer are cut) or the half cut (only the print paper layer of the tape is cut and the release paper layer is not cut) is performed at the boundary between the areas (position indicated by BD in FIG. 8B) or the printing is performed without performing the cutting.

Figure 9A:
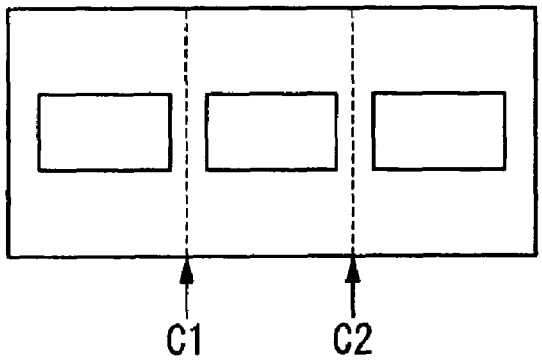
FIG. 9 is an explanatory view of partially cutting of the tape printing system of the first embodiment.
Figure 9B:
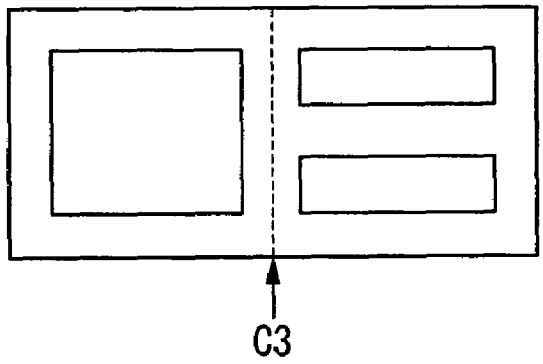
Figure 9C:
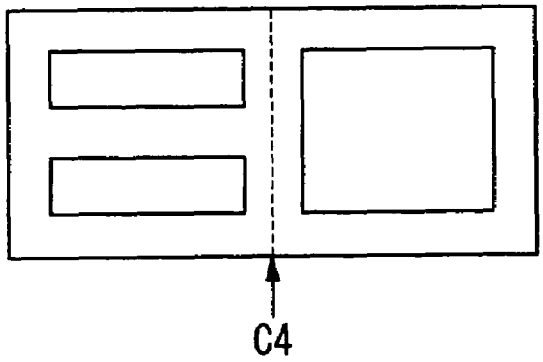

"Specifying whether the partially cutting is performed or not" means that CPU 21 causes the user to specify whether the full cut or the half cut is performed at the boundary between the areas or the printing is performed without performing the cutting when the multi-language printing method in which the printing areas of the character strings having the different type of language are separated in the lengthwise direction of the tape is selected. In the case where the three languages are specified and one of the multi-language printing methods shown in FIGS. 7E to 7F is selected, CPU 21 causes the user to specify whether the partially cutting is performed or not. In the case of FIG. 9A corresponding to FIG. 7E, CPU 21 causes the user to specify whether the full cut or the half cut is performed at the position of C1 and/or C2 or not. In the case of FIG. 9B corresponding to FIG. 7F, CPU 21 causes the user to specify whether the full cut or the half cut is performed at the position of C3 or not. In the case of FIG. 9C corresponding to FIG. 7G, CPU 21 causes the user to specify whether the full cut or the half cut is performed at the position of C4 or not.

When the specification of the multi-language printing method is completed, CPU 21 fetches the character strings corresponding to the plurality of specified languages from the translation dictionary 22*c* and stores the character strings in the text area in accordance with the specified multi-language printing method. CPU 21 also returns the display screen of the liquid crystal display 35 to the input screen including those character strings (sometimes a part of the character strings is not displayed due to the number of characters: Step 210).

Then, CPU 21 turns off the attribute indicator 4-j concerning the multi-language printing method (Step 203), and the CPU 21 returns to the main routine.

Figure 6:
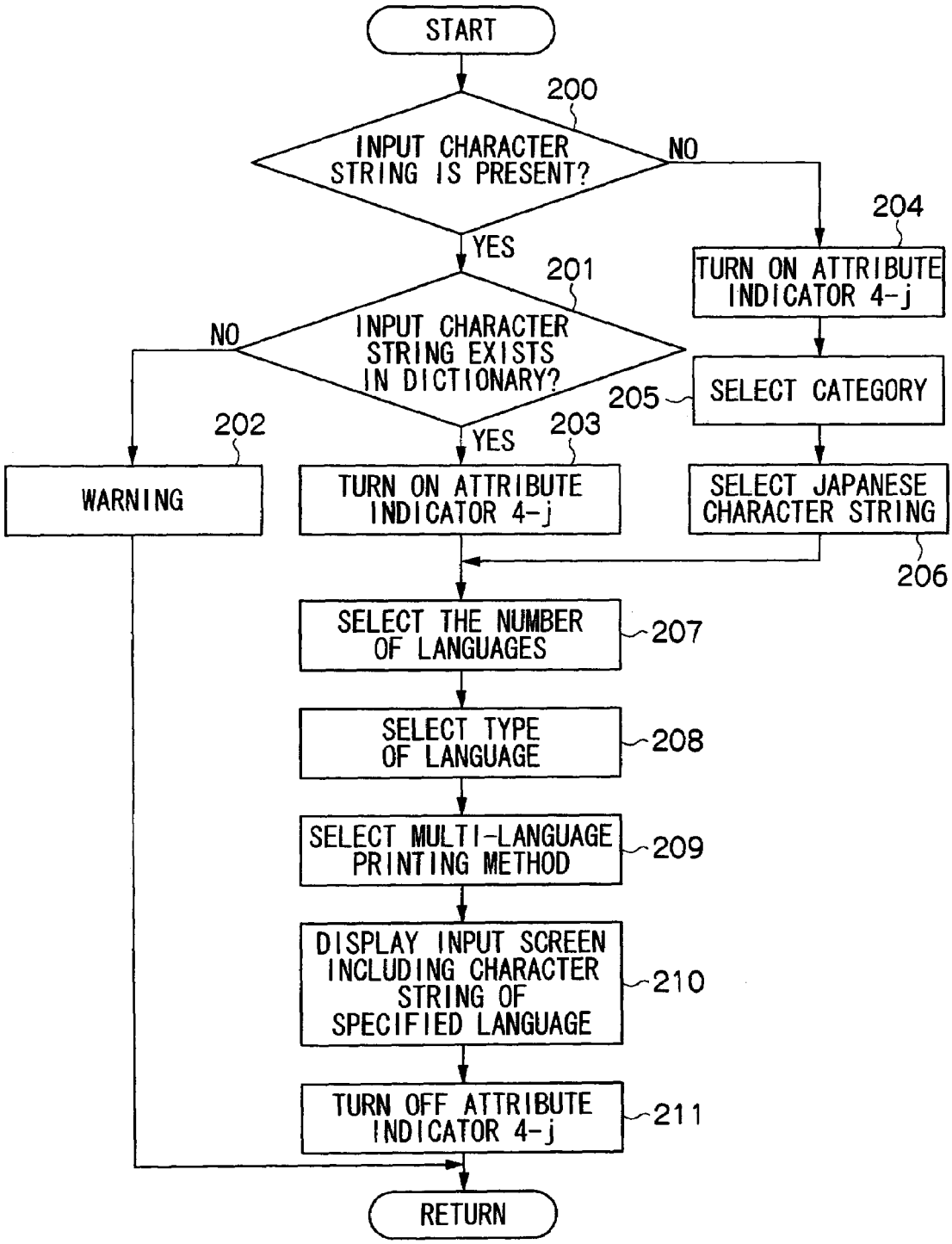
FIG. 6 is a flow chart showing a multi-language printing process of the tape printing system of the first embodiment.

Although the description is omitted in FIG. 6, when the cancel key is operated during the process of FIG. 6, CPU 21 forcedly ends the multi-language printing mode to return to the state immediately preceding the state in which the multi-language printing key 11*b* is operated.

The printing process in the first embodiment is substantially the same as the printing process in the conventional tape printing system. However, as can be seen from the above description, the first embodiment differs from the conventional printing process in that CPU 21 performs the dot expansion processing in which the character (however, the character is not inputted by the user) is automatically included in the print image in the case where the printing of the character defining the type of language is specified, or the printing is suspended, the full cut or the half cut is performed at a position, and then the printing is resumed when the full cut or the half cut is specified.

In accordance with the first embodiment, when the Japanese character string is inputted, the character string of other language corresponding to the Japanese character string can be also inputted without the key input by converting the Japanese character string into the character string corresponding to the other language.

Namely, the user can input the English character string by utilizing the English character keys. In the case where the user does not know the character string (word) in English but knows the character string in Japanese, the user can input the English character string by the language conversion. In the case of German or French, there are some characters to which the character keys can not correspond. However, the peculiar characters in German or French (are not included in alphabetic characters in English) can be also inputted by performing the key input in Japanese to convert the language into German or French.

In accordance with the first embodiment, only the input of the Japanese character string or only the selection of the Japanese character string can form the state in which the character string corresponding to other language is inputted and easily produce the label in which the character strings of the plurality of languages are printed together. When the label in which the character strings of the plurality of languages are printed together is produced, it is a very hard work to perform the key input of all the character strings in each language. However, the multi-language printed label can be easily produced by utilizing the multi-language printing function of the first embodiment.

In this case, the number of languages, the order of the language, and the layout can be easily specified, and the user's desired label in which the character strings of the plurality of languages are printed together can be easily produced.

The multi-language printed label can include the character defining the type of language when the user desires the character defining the type of language. The user can confirm which language is printed at which position if necessary.

In the case where the partially cutting is specified in the multi-language printing method, the cut part can adhere to the arbitrary position, which exerts the effect of diversifying the layout of the multi-language printing.

In accordance with the first embodiment, the translation dictionary can be utilized as the language converting function and the multi-language printing function, and the translation dictionary which occupies the predetermined capacity in the finite storage capacity can be effectively utilized.

(B) Second Embodiment

Figure 10:
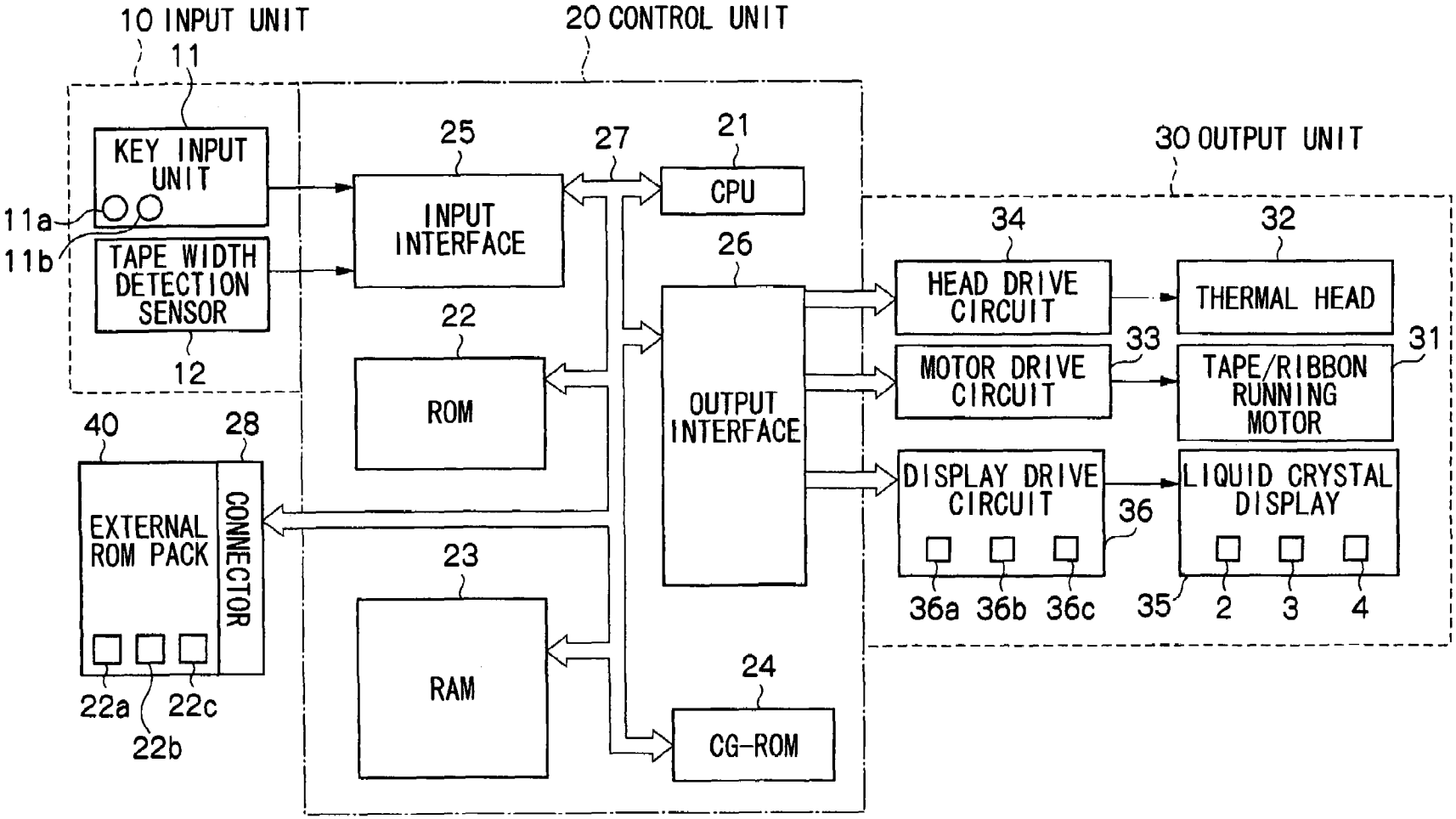
FIG. 10 is a block diagram showing the electrical configuration of the tape printing system of a second embodiment.

FIG. 10 is the block diagram showing the electrical configuration of the tape printing system of a second embodiment. In the second embodiment, the same portion as the first embodiment and the portion corresponding to the first embodiment are indicated by the same numerical reference and sign.

In FIG. 10, the tape printing system of the second embodiment includes an external ROM pack connector 28 connected to the system bus 27 and an external ROM pack 40 connected to the external ROM pack connector 28. One or more ROM chips are stored in the external ROM pack 40. The external ROM pack has the portable shape and is formed in the shape in which the external ROM pack can be attached to the tape printing system. In the second embodiment, the language converting program 22*a*, the multi-language printing program 22*b*, and the translation dictionary 22*c* are stored in the external ROM pack 40.

CPU 21 confirms the connection of the external ROM pack 40 during the power-on and performs the process by utilizing contents stored in the external ROM pack 40.

The tape printing system of the second embodiment can obtain the same effect as the first embodiment. In addition, in accordance with the second embodiment, the user can arbitrarily select the combination of the plurality of languages concerning the language converting function or the multi-language printing function by selecting the external ROM pack 40. For example, the external ROM pack 40 corresponding to Japanese, English, German, and French, the external ROM pack 40 corresponding to Japanese, English, Korean, and Chinese, the external ROM pack 40 corresponding to Japanese, English, German, French, Korean, and Chinese are prepared and the user selects the appropriate external ROM pack 40 among them to attach to the tape printing system. Therefore, the user can arbitrarily select the combination of the plurality of languages concerning the language converting function or the multi-language printing function.

(C) Third Embodiment

Then, a third embodiment in which the apparatus, method and program for producing the small prints of the invention are applied to the system, method and program for printing the tape will be described in detail referring to the accompanying drawings.

The electrical overall configuration of the tape printing system of the third embodiment can be also shown by FIG. 1 according to the first embodiment, so that the drawing will be omitted.

However, a logo/character string label mode key (not shown, but a reference numeral 11*c* is used in the following description) for changing over to the later-mentioned logo/character string label mode and a dictionary consultation key (not shown, but a reference numeral 11*d* is used in the following description) for utilizing the later-mentioned logo/character string corresponding table 22*e* for the input of the character string are provided in the key input unit 11. It is also possible that the logo/character string label mode key is the dedicated key or the key which serves as both the logo/character string label mode key and other function keys. Further, it is also possible that the logo/character string label mode key is a group of keys operated by a predetermined sequence. A program for executing the logo/character string label mode (not shown, but a reference numeral 22*d* is used in the following description), the logo/character string corresponding table (see FIG. 11; not shown in FIG. 1, but a reference numeral 22*e* is used in the following description), and a table utilization dictionary consultation program (not shown, but a reference numeral 22*f* is used in the following description) for utilizing the logo/character string corresponding table 22*e* for the input of the character string are stored in ROM 22.

Figure 11:
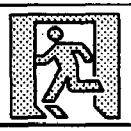
FIG. 11 is an explanatory view showing a table which causes a logo to correspond to character strings of the tape printing system of a third embodiment.

FIG. 11 shows an example of the logo/character string corresponding table 22*e*. In FIG. 11, "○○" in the field indicates that the appropriate information is described in the field.

A logo 22*e*-1, character strings 22*e*-2 to 22*e*-6 in each of languages (For example, Japanese, English, simplified Chinese, traditional Chinese, and Korean) corresponding to the logo, contact address information (URL or telephone number) 22*e*-7 related to the logo, commentary information 22*e*-8 for indicating the meaning or the contents related to the logo, and a sound code string 22*e*-9 corresponding to the logo are included as an element which can be printed in the label in one record in the logo/character string corresponding table 22*e*. The sound code string 22*e*-9 is the code in which the sound can be outputted by a reading apparatus when the corresponding reading apparatus reads the printed sound code string. It is possible that the code is a barcode or the code for ScanTalk (trademark). The one record in the logo/character string corresponding table 22*e* also includes a category 22*e*-10 to which the logo belongs and color correspondence information 22*e*-11. It is possible that the category 22*e*-10 is hierarchized. The color correspondence information 22*e*-11 defines whether the logo is the subject of the color printing or not and provides a color component in the printing.

It is not always necessary that the pieces of information of all the fields are described in one record, and it is necessary that at least the logo 22*e*-1 and the character string of one language (any one of 22*e*-2 to 22*e*-6) are described. It is possible to describe the same number of pieces of commentary information 22*e*-8 as the number of the languages 22*e*-2 to 22*e*-6. It is possible to describe the same number of pieces of sound code string 22*e*-9 as the number of the languages

22*e*-2 to 22*e*-6. It is possible that describe the plurality of pieces of commentary information 22*e*-8 are prepared for one language. For example, it is possible that "Very high temperature" and "Splotch" are prepared as the commentary information concerning "Do not touch" in the Japanese character string 22*e*-2. Like "Smoking is allowed from age of 18" for a no-smoking logo, t is possible that the commentary information is different from the contents expressed by the logo. For the contact address information, when the user accesses the telephone number or URL indicated by the contact address information in the case of "Emergency exit," a passage to the outside of a building is instructed by a voice synthesizer or a home page. For example, in the case of a historic site logo, the sound code string includes the speech of simple guidance about the historic site.

It is possible that not only the system peculiarly has the one record in the logo/character string corresponding table 22*e*, but also the user can edit the one record in the logo/character string corresponding table 22*e* (registration operation will be described later).

Then, the feature operation (method of the tape printing system (method for producing small prints) )of the tape printing system of the third embodiment will be described.

Since the third embodiment has a first feature in the producing operation of the label including the logo and the character string (logo/character string label mode process), the producing operation of the label including the logo and the character string will be described referring to the flow chart of FIG. 12.

Figure 12:
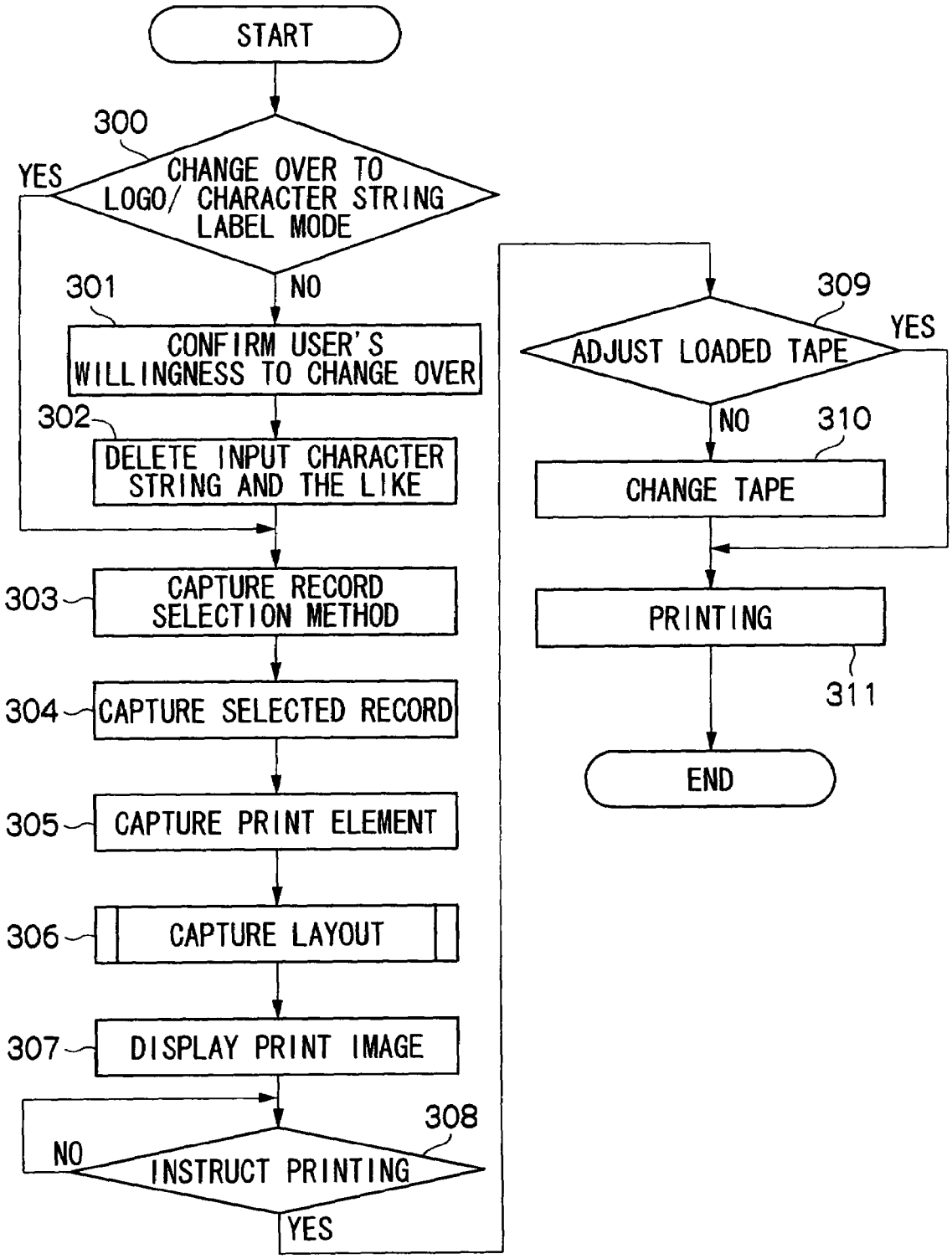
FIG. 12 is a flow chart showing a logo/character string label producing process of the tape printing system of the third embodiment.

When the user operates the logo/character string label mode key 11*c*, CPU 21 starts the program for executing the logo/character string label mode 22*d* shown by the flow chart of FIG. 12.

CPU 21 decides whether change over to the logo/character string label mode can be performed immediately or not (Step 300). When CPU 21 decides that change over to the logo/character string label mode can not be performed, CPU 21 confirms the user's willingness of forced change over by causing the liquid crystal display 35 to display the message asking the user whether the change over to the logo/character string label mode can be performed or not (Step 301). For example, when the logo/character string label mode key 11*c* is operated during the existence of the input character string, however, the input character string is deleted, CPU 21 asks the user whether the change over to the logo/character string label mode can be performed or not. When the user shows the willingness of the forced change over, CPU 21 set the logo/character string label mode to the initial state by deleting the input character string (Step 302).

When CPU 21 can immediately change over to the logo/character string label mode, or when the process of Step 302 is finished, CPU 21 causes the liquid crystal display 35 to display the message asking the user to select a method for selecting one record in the logo/character string corresponding table 22*e*, and then CPU 21 captures the record selecting method selected by the user (Step S303). CPU 21 causes the user to select one record in the logo/character string corresponding table 22*e* in accordance with the record selecting method selected by the user (Step 304).

For example, in the case of the following first and second record selecting methods, either the first record selecting method or the second record selecting method is selected in Step 303 described above.

In the first record selecting method, CPU 21 causes the user to select the category in the lowest hierarchy using the hierarchized category information, and CPU 21 causes the user to select one record from the plurality of records belonging to the selected category of the lowest hierarchy. At this point, until the user is caused to select the category of the lowest hierarchy, CPU 21 causes the user to select the category name by displaying the category names in order from the highest hierarchy. In the selection of the record from the plurality of records belonging to the category of the lowest hierarchy, CPU causes the user to select the record by displaying the logo of each record as the option. Instead of the logo of each record or in addition of the logo of each record, it is also possible that CPU 21 causes the user to select the Japanese character string by displaying the Japanese character string. It is also possible to perform the switch between the logo and the Japanese character string in accordance with the user's operation such as the cursor key.

For example, "public mark" to which the emergency exit and the no-smoking belong or "education" to which animal names and plant names belong is set to the higher hierarchy. "Prohibition mark" to which the no-smoking belongs or "site mark" to which the emergency exit belongs is prepared as the lower hierarchy of "public mark," CPU 21 causes the user to select the record concerning the "no-smoking" or "Do not touch" from "prohibition mark," and CPU 21 causes the user to select the record concerning the "emergency exit" from "site mark." "Animal name" or "plant name" is prepared as the lower hierarchy of "education," CPU 21 causes the user to select the record concerning the "bear" or "lion" from "animal name," and CPU 21 causes the user to select the record concerning the "cherry" or "chrysanthemum" from "plant name."

The second record selecting method is one in which CPU 21 causes the user to select the record by displaying sets of a serial number and the logo of the record in the logo/character string corresponding table 22*e* as the option. In the second record selecting method, instead of the logo of each record or in addition of the logo of each record, it is also possible that CPU 21 causes the user to select the Japanese character string by displaying the Japanese character string. It is also possible to perform the switch between the logo and the Japanese character string in accordance with the user's operation such as the cursor key.

When one record is selected in the above-described manner, CPU 21 causes the user to select the information printed in the label from the pieces of information of the elements (fields) 22*e*-1 to 22*e*-9 which can be printed in the label concerning the record (Step 305).

It is possible that the logo 22*e*-1 is set to the absolute printing item and taken off from the selecting subject (the following description is performed for this case). It is possible that either the simplified Chinese 22*e*-4 or the traditional Chinese 22*e*-5 is selected. It is possible that the upper limit number of elements printed in the label is provided and only the selections of the elements not more than the upper limit number is permitted. Similarly, it is possible that the lower limit number of elements printed in the label is provided and only the selections of the elements not lower than the lower limit number is permitted (the selection of the logo and one other element is set to the lower limit in the following description).

When the selection of the element printed in the label is finished, CPU 21 causes the user to select which position each element is arranged on the label (layout) (Step 306).

Figure 13:
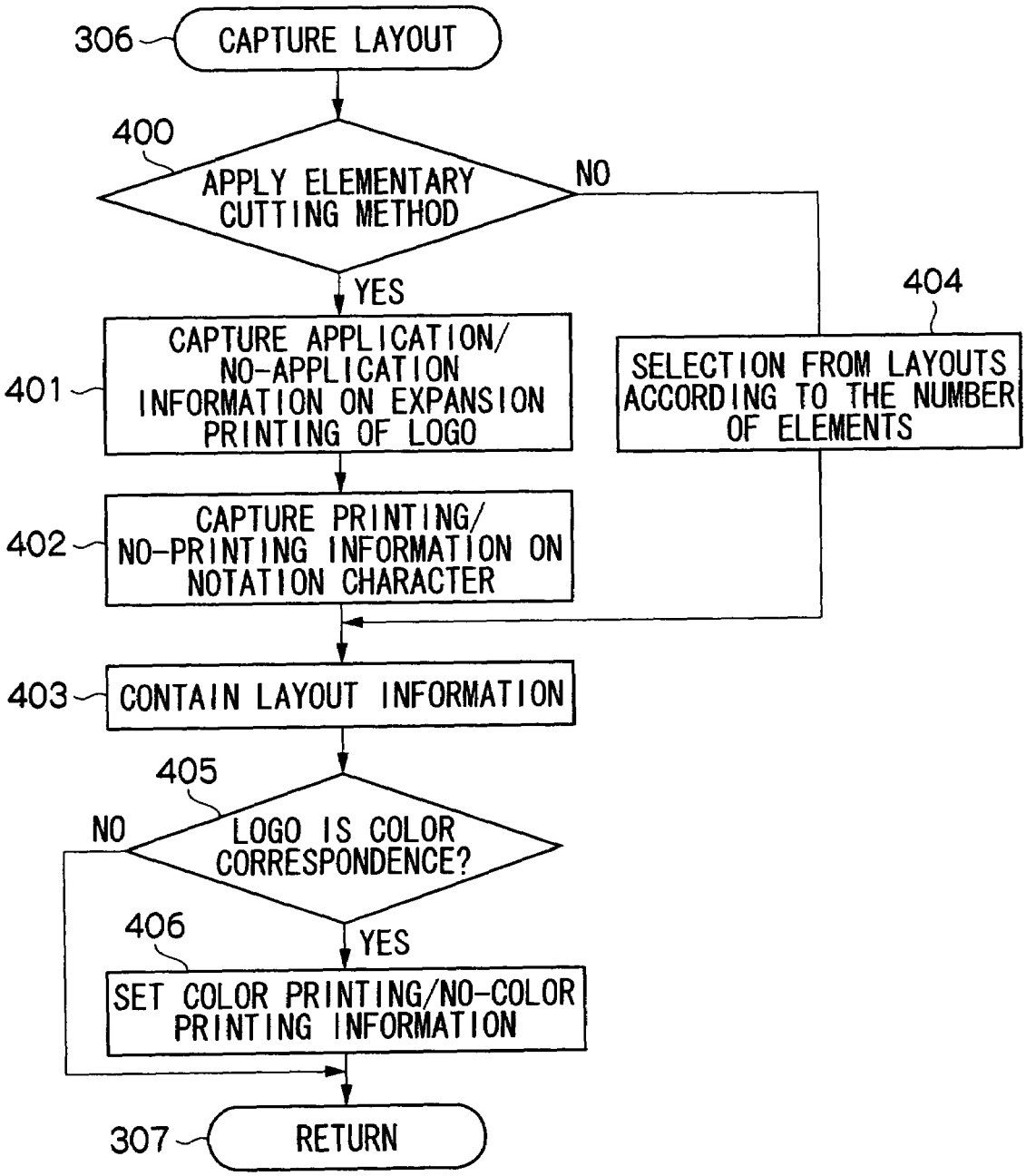
FIG. 13 is a flowchart showing a detail of a layout capturing process in FIG. 12.

FIG. 13 is the flow chart showing the detail of the process of selecting the layout in Step 306.

Figure 14A:
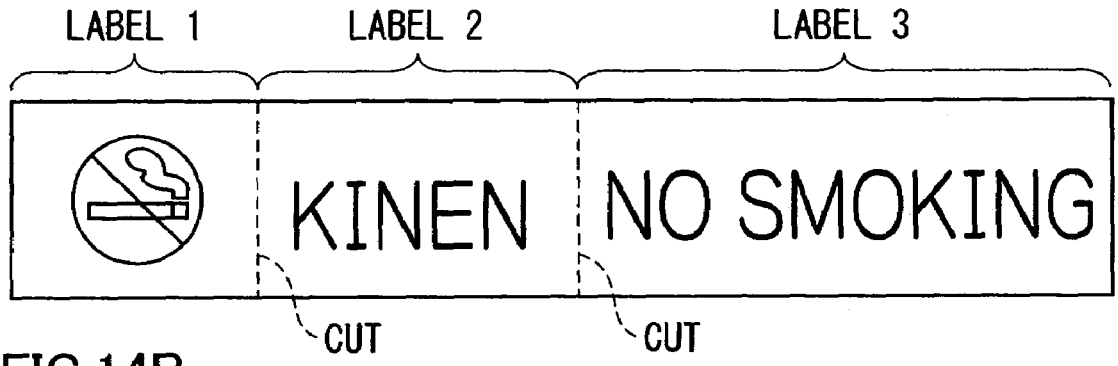
FIG. 14 is an explanatory view of an elementary cutting method of the tape printing system of the third embodiment.
Figure 14B:
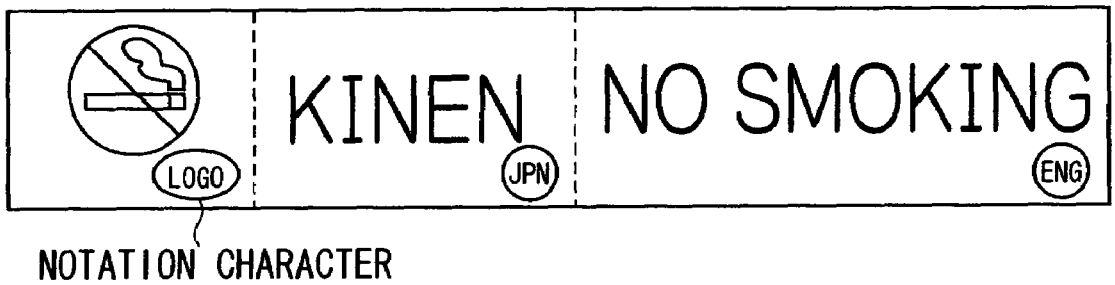

In the process routine shown in FIG. 13, CPU 21 causes the user to select whether the elementary cutting method is applied or not (Step 400). The elementary cutting method is one in which the label is formed in each element selected as the print element and the user can achieve the free layout by arraying the plurality of obtained label in an arbitrary position relationship. For example, FIGS. 14A and 14B are the explanatory view of the image of the elementary cutting method, and FIG. 14B shows the image of the elementary cutting method including the later-mentioned notation character (or notation mark).

When the user selects the application of the elementary cutting method, CPU 21 captures expansion printing function application/no-application information for the logo from the user (Step 401), CPU 21 captures notation character (or notation mark) printing/no-printing information for each element label from the user (Step 402), and CPU 21 performs the storage of the information on the fixed layout (Step 403). The expansion printing function is one which forms the pseudo label having the double tape-width in the case where the label in which the upper half of the logo is expanded and printed and the label in which the lower half of the logo is expanded and printed are formed and arranged in the lengthwise direction of the label. It is also possible to select the expansion printing function more than double.

In the elementary cutting method, it is possible that the plurality of pieces of elementary information are arranged in each element and printed together in the label. In this case, it means that the combination of the elements printed together is selected. It is possible the half cut or the full cut is set to the selection item in the elementary cutting method. In the following description, it is assumed that the full cut is performed.

The notation character (or notation mark) to the label each element is the character or the mark which is printed in the small size in a blank space of the label in order to notify the user that the label belongs to which print element. For example, in the case of the label in which the Japanese character string is printed, "JPN" or "national flag" is printed as the notation character (or notation mark) in the small size on the lower right side of the label.

When the user does not select the elementary cutting method (NO in Step 400), CPU 21 causes the user to select one layout from the plurality of candidates of the layouts determined by the logo and the number of other elements (Step 404) and CPU 21 performs the storage of the information of the fixed layout (Step 403).

Figure 15A:
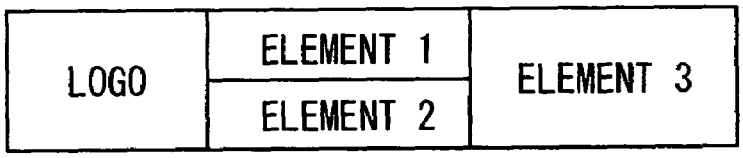
FIG. 15 is an explanatory view showing an example of a display candidate for layout selection of the tape printing system of the third embodiment.
Figure 15B:
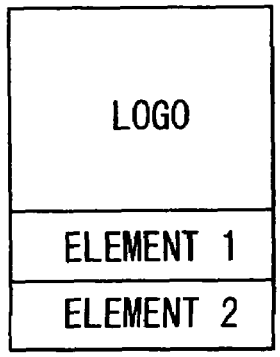
Figure 16A:
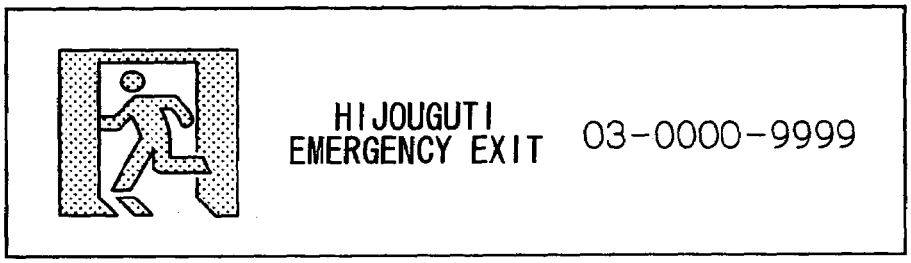
FIG. 16 is an explanatory view showing the produced logo/character string label of the tape printing system corresponding to FIG. 15.
Figure 16B:
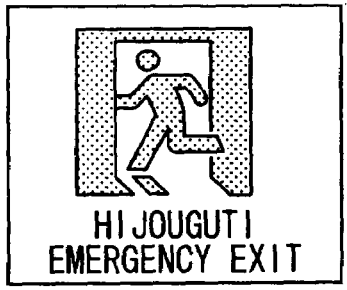

As shown in FIGS. 15A and 15B for instance, the process of selecting the layout in Step 404 includes the selection of the layout independent of the type of element except for the logo and the instruction of the arrangement in which each element is arranged at a position. FIGS. 16A and 16B show the production result of the label corresponding to FIGS. 15A and 15B. In the case where there is the position in which the element except for the logo can be printed together as shown in FIGS. 15A and 15B, it is possible that the user specifies the justification method such as right justification, centering, and uniform arrangement.

When the layout is determined, CPU 21 decides whether the color correspondence information 22*e*-11 in the currently selected record of the logo/character string corresponding table 22*e* indicates color correspondence or not (Step 405). For example, since the logo of the emergency exit is generally in green, it is described that the logo of the emergency exit is the color correspondence of green. It is described that the logo of the attention is the color correspondence of yellow.

When the color correspondence information 22*e*-11 does not become the color correspondence, CPU 21 immediately returns to the main routine shown if FIG. 4. When the color correspondence information 22*e*-11 becomes the color correspondence, CPU 21 causes the user to select whether the color printing (or limitation of tape color) is performed or not, and CPU 21 capture the information on the color printing from the user to cause to the user to set the information (Step 406). Then, CPU 21 immediately returns to the main routine shown if FIG. 12.

When the layout is fixed, CPU 21 displays the print image by confirming whether the elementary cutting method is selected or not or determining print attributes (Step 307) and CPU 21 waits for the operation of a printing execute key (Step 308). In the case where the user provides the instruction of retry for the display of the print image, CPU 21 returns to the process of selecting the record in Step 304, the process of selecting the print element in Step 305, or the process of selecting the layout in Step 306.

When the user provides the instruction of the printing, CPU 21 confirms whether the loaded tape can perform the printing or not (Step 309). When the loaded tape can not perform the printing, CPU 21 causes the liquid crystal display 35 to display the message of the replacement to replace the tape (Step 310). For example, in the case of the color correspondence, the tape is replaced unless the tape of the color correspondence is loaded.

Then, CPU 21 performs the dot expansion of the printed element to print the element in the tape by confirming whether the elementary cutting method is selected or not or determining print attributes (Step 311). When the printing to the tape is finished, CPU 21 finishes the series of processes and returns the apparatus to the state immediately preceding the state in which the logo/character string label mode key 11*c* is operated. It is possible that the message asking whether the printing is finished or the printing of the same contents is repeated is displayed when the printing to the tape is finished and then CPU 21 returns the apparatus to the state immediately preceding the state in which the logo/character string label mode key 11*c* is operated when the user requires the finish of the printing.

In the case where the elementary cutting method is selected, the cutting process is performed in each finish of the printing of the element contents to the tape. When the apparatus has an automatically cutting mechanism, the full cut (or the half cut) is automatically performed. When the apparatus has a manually cutting mechanism, CPU 21 display the massage asking the user to cut the tape, and CPU 21 returns to the printing of the next element when CPU 21 detects the cut.

The action, in which the logo/character string corresponding table 22*e* which is of the second feature of the tape printing system of the third embodiment is utilized for the input of the character string, will be described below referring to the flow chart of FIG. 17.

Figure 17:
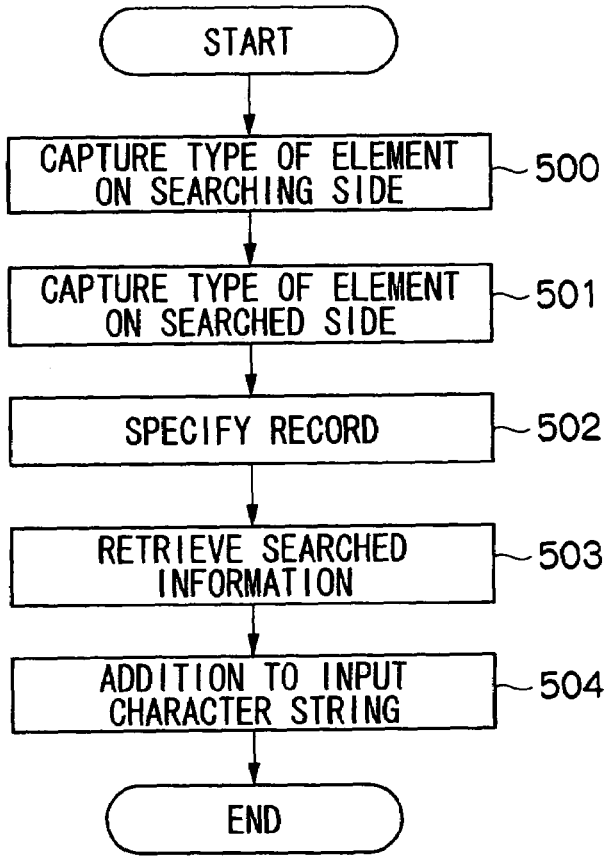
FIG. 17 is a flow chart showing a dictionary consultation process of the tape printing system of the third embodiment.

When the dictionary consultation key 11*d* is operated in the normal input action, CPU 21 starts the table utilization dictionary consultation program 22*f* shown in FIG. 17. CPU 21 first causes the liquid crystal display 35 to display the message asking the user to specify the type of element of the table which becomes the searching side in the dictionary consultation, and CPU 21 captures the type of element on the searching side specified by the user (Step 500). CPU also causes the liquid crystal display 35 to display the message asking the user to specify the type of element of the table which becomes the searched side in the dictionary consultation, and CPU 21 captures the type of element on the searched side specified by the user (Step 501).

For example, in the dictionary consultation in which the logo is set to a search key to fetch the commentary information corresponding to the logo from the logo/character string corresponding table 22*e*, the user specifies the "logo" as the type of element on the searching side and specifies the "commentary information" as the type of element on the searched side. At this point, it is possible that both the type of element on the searching side and the type of element on the searched side are limited. For example, it is possible that only the logo 22*e*-1 and the Japanese character string 22*e*-2 are permitted as the type of element on the searching side. It is possible that the specifications of the plurality of types are permitted in the type of element on the searched side. It is also possible that the type of element on the searched side is not specified in Step 501 and the type of element on the searched side is specified after the record is specified in the later-mentioned manner.

When both the type of element on the searching side and the type of element on the searched side are specified, CPU 21 causes the user to specify one record in the logo/character string corresponding table 22*e* by displaying the candidate in the type of element on the searching side (Step 502). In this case, it is possible that CPU 21 causes the user to specify the record by displaying the candidates in the type of element on the searching side at the stage in which the candidates is narrowed to a certain extent by utilizing the category.

Then, CPU 21 fetches the information on the type of element on the searched side in the specified record (Step 503). CPU 21 adds the captured information to the position subsequent to the input character string position where the cursor is located, when the dictionary consultation key 11*d* is operated (Step 504) and the CPU returns to the normal input action state. Depending on the process of adding the captured information, the data is added to the text area or the display buffer is updated by the addition of the captured information.

In accordance with the table utilizing dictionary consultation function, For example, it is possible that the logo (for example, bear pattern) is specified and the Korean character string corresponding to the logo (notation of the bear in Korean) is captured to include the Korean character string in the input character string. For example, it is possible that the Japanese character string is specified and the English character string corresponding to the Japanese character string is captured to include the English character string in the input character string. Further, for example, it is possible that the Japanese character string is specified and the logo corresponding to the Japanese character string is captured to include the logo in the input character string.

It is also possible to provide the user registration function for the logo/character string corresponding table 22*e*. In this case, the logo/character string corresponding table 22*e* can be further enriched. Although the flow chart is omitted, the user registration function for the logo/character string corresponding table 22*e* will be simply described.

When the key starting the user registration function for the logo/character string corresponding table 22*e* is operated, CPU 21 enters the user registration mode and determines the empty record having the smallest serial number in the registration area. Then, CPU 21 causes the user to select the symbol or registered external character as the logo from the symbols or the registered external characters, and CPU 21 causes the user to arbitrarily input other fields.

It is possible that only the Japanese character string and the category are set to the necessary input field and the empty field is permitted in other fields. It is preferable that the category is selected and inputted from the category names which are previously prepared by the apparatus.

It is also possible to permit the registration of the sound code string 22*e*-9 by the user. For example, the user causes the characters of "CDEFGAB" to correspond to musical intervals of "do, re, mi, fa, so, la, shi" (each key indicative of the characters of "CDEFGAB" and a predetermined key are simultaneously pressed in treble and bass), and the user inputs a musical score while the user causes one-time press of the character key+execution, two-times press of the character key+execution, and three-times press of the character key+execution correspond to an eighth note, a quarter note, and a half note respectively. For example, the user inputs the sound code string by using software (incorporated in the apparatus) for changing the musical score to the sound code string.

When the external character is produced by the external character registration function to operate the registration key, it is also possible that, while CPU 21 registers and contains the external character, CPU 21 displays the message asking the user whether the change over to the user registration function for the logo/character string corresponding table 22*e* is performed or not and performs the change over to the user registration function for the logo/character string corresponding table 22*e*.

In accordance with the third embodiment, the logo and the character string and the like are stored in the logo/character string corresponding table 22*e* while the logo corresponds to the character string and the like, and print elements are fetched from the table to produce the label when the label having the logo and the character string and the like is produced, so that the user can easily produce the label having the print contents including the logo such as the public mark.

At this point, since the character strings in the plurality of languages, the commentary information, the contact address, and the sound code string are prepared as the elements corresponding to the logo, various labels can be formed depending on the selection of the type of element included in the label, and the user can realize the desired label which is selected from the various labels. The selection of the record on the table can be performed by not only the selection of the logo but also the selection utilizing other elements, so that the usability is improved.

Since the user registration function for the logo/character string corresponding table 22*e* is provided, the user can repeatedly produce the user's original label including the logo and the character string at a time interval and different places.

Since the elementary cutting method is provided in, the user can realize the pseudo label of the layout in which the user arbitrarily arranges each of the element labels.

Further, in accordance with the third embodiment, the logo/character string corresponding table is used as the input conversion table and the logo/character string corresponding table can be caused to be utilized for the input of the character string of the desired element and the like, so that the usability can be enhanced. For example, even if the user does not know the notation (character string) in Korean corresponding to the emergency exit, the user can input the notation in Korean corresponding to the emergency exit by specifying the logo for the emergency exit to select the notation in Korean corresponding to the emergency exit.

(D) Fourth Embodiment

Then, a fourth embodiment in which the apparatus, method and program for producing the small prints of the invention are applied to the system, method and program for printing the tape will be described in detail while the difference between the fourth embodiment and the third embodiment is focused on. In the tape printing system of the fourth embodiment, since the overall configuration is substantially the same as that shown in FIGS. 1 and 2 according to the first embodiment, the drawing of the overall configuration will be omitted. The following description is given by properly using the reference numerals and signs in FIGS. 1 and 2.

Figures 18A, 18B:
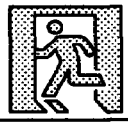
FIG. 18 is an explanatory view showing the configuration of fixed data of the tape printing system of a fourth embodiment.

The tape printing system of the fourth embodiment has first and second storage units 22*e* L and 22*e* C shown in FIGS. 18A and 18B as the storage unit corresponding to the logo/character string corresponding table 22*e* of the third embodiment. The field shown in FIGS. 18A and 18B corresponding to the field of FIG. 11 is indicated by the same reference numeral.

As shown in FIG. 18A, the logo 22*e*-1, the color correspondence information 22*e*-11, and the category 22*e*-10 are stored in the first storage units 22*e*L. It is also possible that the category is hierarchized. It is possible that the existing storage unit is also used for the first storage units 22*e*L. As shown in FIG. 18B, the second storage units 22*e*C includes the character strings 22*e*-2 to 22*e*-6 in each of languages (For example, Japanese, English, simplified Chinese, traditional Chinese, and Korean) corresponding to the logo, the contact address information (URL or telephone number) 22*e*-7, the commentary information 22*e*-8, the sound code string 22*e*-9, and the category 22*e*-10. It is also possible that the category is hierarchized.

Although the emergency logo (see FIG. 16) is generally used in order to indicate "emergency exit," the emergency logo can also correspond to "emergency staircase." For example, the record for "emergency exist" and the record for "emergency staircase" are individually prepared in the second storage units 22*e*C, and the record for "emergency exist" or the record for "emergency staircase" can arbitrarily correspond to the emergency logo in the later-mentioned way. For example, the record for "Go rightward" (it is also possible to use an arrow symbol "→" instead of the characters), "Go straight ahead," and "Walk up stairs" are prepared as each of the records for the emergency exit logo expressed in Japanese character string in the second storage units 22*e*C, and the record suitable to the place where the label adheres can be selected. For example, the logo (hereinafter referred to caution logo) having an exaggeration mark "!" in the center of a triangle of "Δ" prompts the caution regardless of the type of caution item, and the arbitrary caution item can correspond to the caution logo when the records of the many types of the caution items (foe example, "caution high temperature," "caution high voltage," and "Caution falling object") are stored in the second storage units 22*e*C.

In the tape printing system of the fourth embodiment, design form input is utilized for the input of the label information including the logo and the character string.

When a form input key in the key input unit 11 is operated, CPU 21 causes the liquid crystal display 35 to display a menu screen (not shown) including form candidate names such as "address label form," "label form for circulation," "label form for furniture and fixture management," and "logo/character string label form." It is possible that the form input key is dedicated key or general-purpose key. When "logo/character string label form" is selected, CPU 21 starts the execution of a program of producing the logo/character string label 22*g*. The program of producing the logo/character string label 22*g* of the second embodiment is also stored in ROM 22 (see FIG. 1).

Figure 19:
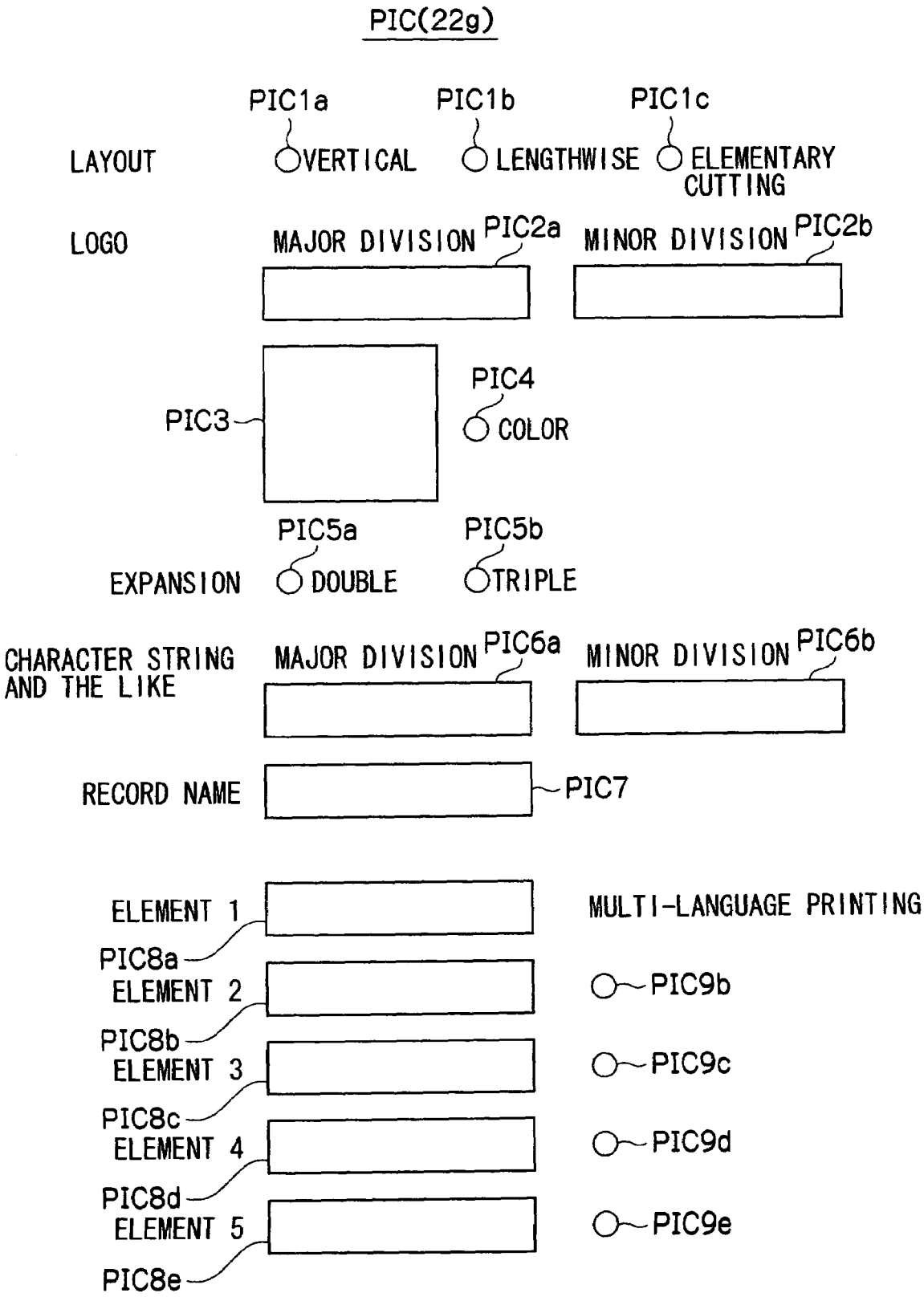
FIG. 19 is an explanatory view showing a form input screen for the logo/character string label of the tape printing system of the fourth embodiment.

The program of producing the logo/character string label 22*g* exhibits a form input screen PIC for the logo/character string label as shown in FIG. 19, and CPU 21 captures the information. Sometimes the form input screen PIC for the logo/character string label is partially displayed depending on the display size of the liquid crystal display 35, and the partially displayed screen can be vertically and horizontally scrolled in accordance with the operation of the cursor key.

In the form input screen PIC for the logo/character string label shown in FIG. 19, as a layout, only one of "vertical layout," "lengthwise layout," and "elementary cutting" can be selected. For example, the selection is performed by clicking radio buttons PIC1*a* to PIC1*c*.

"Vertical layout" is one in which, as shown in FIG. 16B described above, the logo is located on the uppermost portion and other contents of the print elements are vertically printed while located below the logo. The central justification is applied to the character justification. However, it is also possible to select the character justifications of other print elements. "Lengthwise layout" is one in which, as shown in FIG. 16A described above, the logo is located on the leftmost portion and other contents of the print elements are horizontally printed while located on the right side of the logo. Even in the case of the lengthwise layout as described later, there is a possibility that the contents of the plurality of print elements are vertically printed. "Elementary cutting" is the pseudo layout forming the elementary labels. As described in the third embodiment, it is also possible to select whether the cut in "elementary cutting" is performed by the full cut or the half cut. It is also possible to select whether the notation character (or notation mark) is printed with the logo and other print elements or not.

In the form input screen PIC for the logo/character string label, with reference to the logo, major division and minor division of the category can be specified. The major division and minor division of the category may be specified by the menu screen displayed by moving the cursor to input display fields PIC2*a* and PIC2*b* to operate the candidate key, or the major division and minor division of the category may be specified by the character input of the category name after the cursor is moved to input display fields PIC2*a* and PIC2*b*.

Immediately after the major division and minor division of the category concerning the logo is determined, one logo belonging to the specified category (major division and minor division) is displayed as the candidate in a logo display field PIC3, the displayed logo is changed in accordance with the change of the candidate change key ("preceding candidate key" or "next candidate key"), and the selection of the logo is determined by the execution key. When the selected logo is the color correspondence, it is assumed that a radio button PIC4 for the color printing can be clicked. When the radio button PIC4 is clicked, the color printing (or the restriction of the tape color) can be performed.

In the fourth embodiment, only the logo can be expanded and printed (it is also possible to permit other print elements to be expanded and printed), and double expansion printing and triple expansion printing can be specified by radio buttons PIC5*a* and PIC5*b*. It is also possible to permit the logo expansion printing only when "lengthwise layout" or "elementary cutting" is selected.

For the print elements (corresponding the record of the second storage units 22*e*C) except for the logo, the major division and minor division of the category can be specified to input display fields PIC6*a* and PIC6*b* in the form input screen PIC for the logo/character string label. In the case where the category specified to the print elements except for the logo and the category specified to the logo have no relationship previously determined by the apparatus, CPU 21 rejects the specification of the category concerning the print elements except for the logo and requests the retry of the specification. It is also possible CPU 21 rejects the specification of the logo. Further, it is also possible that CPU 21 requests the retry of the specification of both the logo and the print elements except for the logo. The previously determined relationship between the categories is not limited to the coincidence in the minor division. It is also possible that the previously determined relationship is the coincidence in the major division or the pseudo relationship between the major divisions. In the fourth embodiment, whether the logo and the print elements except for the logo can be combined or not was decided on the basis of the category. However, instead of the method of the forth embodiment or in addition to the method of the forth embodiment, it is also possible to use another requirement.

In the case where the category specified to the print elements except for the logo is consistent with the category specified to the logo, CPU 21 causes the cursor to be located in a print element record name field PIC7. For example, the notation of the Japanese character string 22*e*-2 of each record is utilized as the record name of the second storage units 22*e*C, and the user specifies the record intended in the notation of the Japanese character string 22*e*-2. The candidate displayed in the print element record name field PIC7 is the record belonging to the category (major division and minor division) defined by the input display fields PIC6*a* and PIC6*b*.

However, the number of print elements except for the logo included in the logo/character string label may be arbitrary, an example in which the upper limit of the number of print elements except for the logo is set to five in the form input screen PIC shown in FIG. 19.

The character strings 22*e*-2 to 22*e*-6 in each of languages (For example, Japanese, English, simplified Chinese, traditional Chinese, and Korean) corresponding to the specified record of the second storage units 22*e*C, the contact address information (URL or telephone number) 22*e*-7, the commentary information 22*e*-8, and the sound code string 22*e*-9 can be arbitrarily specified with no overlap to input display fields PIC8*a* to PIC8*e* to which the serial numbers "1" to "5" are given. It is necessary to perform the specification with no space in ascending order of the serial number.

In the case where "vertical layout" is specified, the contents of the print element in ascending order of the serial number are printed with the logo on the lower side of the logo on the label.

In the case where "lengthwise layout" is specified, the contents of the print element in ascending order of the serial number are printed with the logo on the right side of the logo on the label. In the case of "lengthwise layout," the contents of the plurality of print elements can be printed with the logo at the same positions in the lengthwise direction on the label. When multi-language printing radio buttons PIC9*b* to PIC9*e* are clicked, the contents of the print element are printed with the contents of the print element whose serial number is smaller than that of the contents of the print element by one in the tape width direction. In the label shown in FIG. 16A, the Japanese character string is selected in the input display field PIC8*a* having the serial number "1," the English character string is selected in the input display field PIC8*b* having the serial number "2," and the contact address is selected in the input display field PIC8*c* having the serial number "3." The label shown in FIG. 16A corresponds to the case in which the radio button PIC9*b* corresponding to the input display field PIC8*b* is clicked.

In the case where "elementary cutting" is specified, after the label having only the logo is produced, the label concerning each of the print elements in order of the serial number is produced. The multi-language printing radio buttons PIC9*b* to PIC9*e* are also valid when "elementary cutting" is specified. When the multi-language printing radio buttons PIC9*b* to PIC9*e* are clicked, the contents of the print element are printed with the contents of the print element whose serial number is smaller than that of the contents of the print element by one.

When the printing key is operated in the state in which the information for forming the label is selected or inputted to the form input screen PIC, similarly to the third embodiment, the printing action is performed. It is also possible to perform the confirmation on the print image display in advance of the printing action.

In the fourth embodiment, it is also possible to provide the user registration function to the first storage units 22*e*L for the logo and the second storage units 22*e*C for the other print elements. It is also possible to provide the dictionary consultation function to the second storage units 22*e*C.

In accordance with the fourth embodiment, the logo and the character string corresponding to the logo and the like are stored in the individual storage unit, and the logo and the other print elements are fetched from each storage unit to produce the label in accordance with the form input method when the label having the logo and the character string and the like is produced. Therefore, the user can easily produce the label of the print contents including the logo such as the public mark.

Further, in accordance with the fourth embodiment, since the logo and the character string corresponding to the logo and the like are stored in the individual storage unit, the different character strings can correspond to each other even if the same logo is applied, and the various types of logo/character string labels can be produced.

Other effects of the fourth embodiment are substantially similar to the effects of the third embodiment.

(E) Other Embodiments

Although the various modifications is described in each of the first to fourth embodiments, the modifications illustrated in the following descriptions can be further cited.

While the Japanese character string is inputted before the language converting key 11*a* is operated in the first and second embodiments, it is also possible that the Japanese character string is inputted after the language converting key 11*a* is operated, instead of the first and second embodiments, or in addition to the first and second embodiments. In this case, the type of language of the initial character string provided for the conversion is not limited to Japanese. For example, in the case where the tape printing system for which sale in the United State is intended, it is possible that the type of language of the initial character string provided for the conversion is English. It is also possible that the user specifies the type of language of the initial character string provided for the conversion.

While the change over to the multi-language printing mode is performed by the operation of the multi-language printing key 11*b* in the first and second embodiments, it is also possible to provide the multi-language printing function as one aspect of the form input function which is provided for simply producing a spine label of a VTR cassette or address label.

While the character string except for the character string of the multi-language printing can be inputted when the label is produced by utilizing the multi-language printing function in the first and second embodiments, it is also possible that only the character string of the multi-language printing is included in the label utilizing the multi-language printing function.

While the Japanese character string is inputted to obtain the character string of another language corresponding to the Japanese character string in the multi-language printing function in the first and second embodiments, it is also possible to permit the language except for Japanese as the language of the initially inputted character string, or it is also possible that to permit the plurality of languages as the language of the initially inputted character string. It is possible that the character strings of each of the languages are individually inputted. It is possible to confirm the correlation of languages of the individually inputted languages to perform the multi-language printing. For example, the set of "kusuri" and "yakuhin" is previously caused to correspond to the set of "drug" and "medicine," the multi-language printing is permitted when the elements of the both sets are inputted, and the multi-language printing is rejected when the word which does not belong to both the set of "kusuri" and "yakuhin" and the set of "drug" and "medicine" is inputted.

The initially inputted language is not limited to the character string of the word or a word string. It is possible that the initially inputted language is the character string of pronunciation (reading). For example, as shown in FIG. 20, the translation dictionary is formed by the character strings of the word strings and the character strings of the pronunciations, and the character string of the pronunciation (reading) is initially inputted, which allows the desired character string to be obtained. For example, when "syuga-" is inputted, "SUGAR" can be obtained.

While European and American language such as English is expressed by the small character notation in the first and second embodiments, it is also possible that European and American language is expressed by the large character notation. It is also possible that the user selects the small character notation or the large character notation.

While the word or the word string is converted into another language in the first and second embodiments, it is also possible that software for mechanical translation and the translation dictionary utilized by the software for mechanical translation are incorporated to translate a sentence into the sentence in another language. It is also possible to perform the language conversion of the amount of money such as 1000 yen, a physical and chemical unit such as one centimeter, and the like. In this case, it is possible to perform the conversion calculation into the general unit in the language. For example, it is possible that "senti" or "syaku" in Japanese is automatically converted into "inch" in English.

In the case of the color printing correspondence, it is possible that the user can select the combination of the language or the logo and the color, or it is also possible that the combination of the language and the color is fixed by the system.

While the multi-language printing of the character strings of the plurality of languages or the logo is shown in the first to fourth embodiments, it is also possible that the cutting and printing can be specified in each language from the beginning. In this case, it is possible to specify the number of prints in advance of the printing such that the logo label is ten prints, the Japanese label is five prints, the English label is three prints, and the Chinese label is ten prints. For "vertical layout" or "lengthwise layout" in the third and fourth embodiments, after the elements A to E are specified as the application element, it is also possible to permit the specification of the number of prints such that the logo+the elements A to D label is five prints and the logo+the elements A to E label is four prints.

Figure 21A:
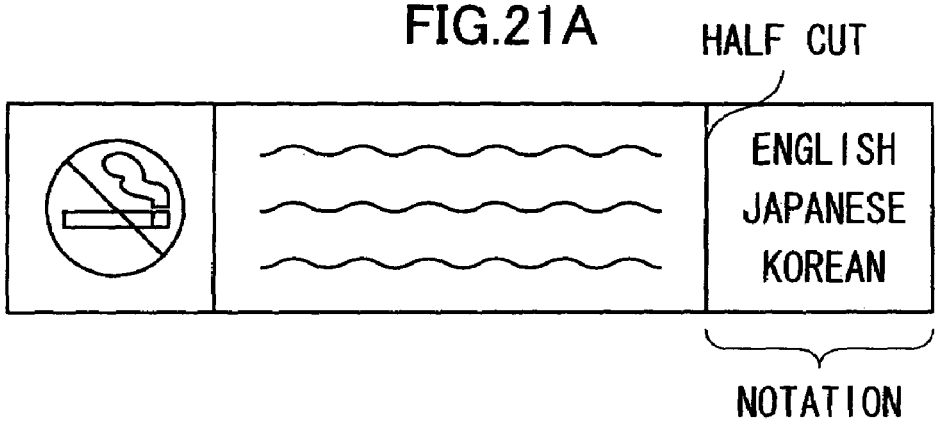
FIG. 21 is an explanatory view showing a logo/character string label (1) in another embodiment which modifies the third or fourth embodiment.
Figure 21B:
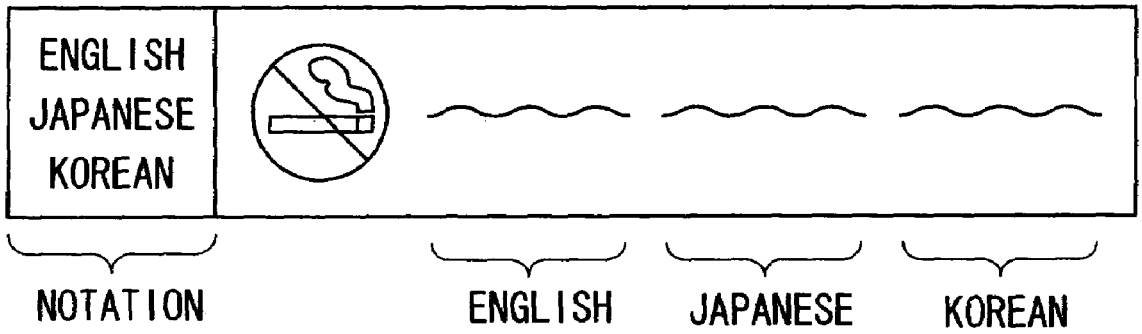

In the notation character defining the type of language for notifying the user of the locations of the character strings of the languages and the logo in the multi-language printing label, it is possible to print a backside of the label. It is possible that the difference of the character strings of the type of languages or the logos can be discriminated by the background pattern of the label. While the notation character (or notation mark) indicating the print element including the logo on the label is printed only in the case of "elementary cutting method" in the third and fourth embodiments, it is also possible that possible the notation character (or notation mark) is printed for "vertical layout" or "lengthwise layout." It is also possible that the notation character (or notation mark) is printed in the size similar to other characters. FIGS. 21A and 21B show the print layout of the notation characters concerning "lengthwise layout." FIG. 21A shows the types of language (notation characters) of the print elements printed together in the vertical direction except for the logo are printed while arranged in the vertical direction. For example, the half cut is performed to this portion. FIG. 21B shows the types of language (notation characters) of the print elements printed together in the lengthwise direction except for the logo are printed while arranged in the vertical direction. For example, the half cut is performed to this portion.

Figure 22:
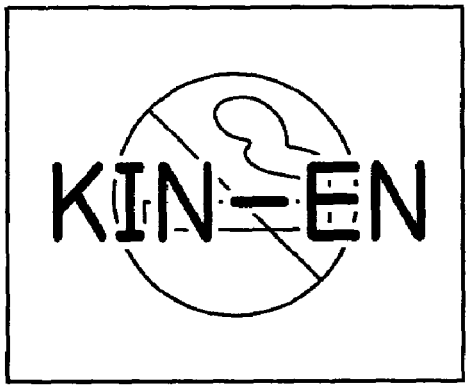
FIG. 22 is an explanatory view showing a logo/character string label (2) in another embodiment which modifies the third or fourth embodiment.

While the character strings of the plurality of languages and the logo are printed together in the above-described embodiments, it is also possible that the character strings of the plurality of languages and the logo are overwritten in the same area. In this case, it is possible one of the character strings of the plurality of languages and the logo is decreased in gradation and printed like the background. It is also possible that the different colors are applied depending on the language or the logo. FIG. 22 shows an example of the label in which the logo and other element are overwritten. In this case, it is also possible that tone on the logo side is made the background pattern such that the tone on the logo side is made half tone. It is assumed that the word of "multi-language printing" includes the overwriting.

While the candidate is cyclically changed in the language in which the language conversion has been performed and the language determined when the execution key is operated in the first and second embodiments, it is also possible that the language in which the language conversion has been performed is selected from the menu and the character string of the language is fetched from the translation dictionary 22*c*.

While all the language converting program 22*a*, the multi-language printing program 22*b*, and the translation dictionary 22*c* are stored in the external ROM pack 40 in the second embodiment, it is also possible that only the translation dictionary 22*c* is stored in the external ROM pack 40. It is also possible that the external ROM pack 40 is other storage mediums. It is also possible that ROM in the apparatus main body and the external ROM pack 40 separately contain the character strings of the different languages.

Needless to say, it is possible that the special printing function such as the expansion printing function and continuous printing function is applied to the printing of the contents to which the multi-language printing is inputted.

While the data such as the character string read out from the table is fixed in the first and second embodiments, it is also possible to change the data after the readout. For example, when the user reads the "kusuri" and "drug," it is possible that the user changes "kusuri" and "drug" to "kusuriten" and "drugstore" by utilizing "kusuri" and "drug." It is also possible to permit the similar modification in the third and fourth embodiments.

It is possible that the user inputs the character string of the language which the apparatus does not prepare and prints the character string in the multi-language printed label. For example, in the case where the apparatus prepares Japanese, English, German, and French, it is possible that the kanji of Chinese as the fifth language is added to only the multi-language printed label which is currently produced and the kanji is permitted to print. In this case, it is possible to perform or not to perform the input that the character string which is currently produced is Chinese in the system.

Even if the tape printing system is formed by the dedicated machine, it is possible that the number of logos and the number of languages for producing the logo/character string label are increased by applying the external ROM pack (or other storage mediums).

While the tape printing system is shown as the dedicated machine in the above-described embodiments, it is also possible that the technical thought of the invention is applied to the tape printing system in which the personal computer and the label printer are integrated. It is also possible that the technical thought of the invention is applied to a stamp producing system as the dedicated machine in which the personal computer and the peripheral for producing the stamp are integrated.

In the case where the invention is applied to the tape print system in which the personal computer and the label printer are integrated, it is possible that a WYSIWYG method or a drug and drop method is applied to the determination of the layout of the multi-language printed label or the logo/character string label. For example, it is possible that the user produces the layout by moving the displays of the character strings of the respective languages and the logo from the window in which the character strings of the respective languages and the logo are listed to the blank label image portion.

While the position of the logo is fixed (uppermost portion or leftmost portion) in "vertical layout" or "lengthwise layout" in the third and fourth embodiments, it is also possible that the position of the logo is fixed at other positions except for the uppermost portion or leftmost portion, or it is possible that the user specifies the position of the logo. It is preferable that the attribute information such as the character size in the layout is described in the relative value expression and the attribute information is converted into the absolute value in accordance with a width of the label tape. In this case, the same modification can be cited for the first and second embodiments.

It can be cited as an example of the modifications of the third and fourth embodiments that the user can input the character string which the apparatus does not prepare to print the character string in the logo/character string label. For example, an input field which the user can freely enter is provided in the form input screen PIC for the logo/character string label. When the character string is inputted to the input field, the character string is printed at the position closest to the logo.

The type of language such as the character string, which is prepared assuming that the apparatus can causes the character string to correspond to the logo, is not limited to the third and fourth embodiments. It is possible that the types of languages include at least two languages, and it is possible that the two languages include Japanese normal characters and Japanese Braille characters. In this case, the Braille expressing the expression or the Braille pattern correspond with the logo may be, in the later case, it is also possible that the expression or the meaning in Japanese or English for the Braille pattern is printed together with the Braille or the character.

While the sound code string, which is outputted in sound when the reading action is performed with the predetermined apparatus, can be printed while included in the logo/character string label in the third and fourth embodiments, it is also possible that another type of sound information is printed while included in the logo/character string label. For example, it is possible that sound data corresponding to the logo is stored as a data string of notes expressing a sound pitch and a sound length and, in printing the sound information in the logo/character string label, note symbols are arranged in a five-line staff notation which is previously prepared by the apparatus. It is also possible that the apparatus separately has the five-line staff notation printing function independently of the logo/character string label. In this case, for example, the method in which, the user causes the characters of "CDEFGAB" to correspond to the musical intervals of "do, re, mi, fa, so, la, shi" (each key indicative of the characters of "CDEFGAB" and a predetermined key are simultaneously pressed in treble and bass), and the user inputs a musical score while the user causes one-time press of the character key+execution, two-times press of the character key+execution, and three-times press of the character key+execution correspond to an eighth note, a quarter note, and a half note respectively, can be cited as an example of the user input.

It is also possible that the dictionary consultation function prepared by the apparatus of the third and fourth embodiments is utilized for a teaching function. For example, the apparatus enters a teaching mode by the operation of an appropriate teaching function key, and the user determines a questioning side element and a questioned side element. For example, the animal logos are specified as the questioning side element and the English notations (English character string) of the animal logos are specified as the questioned side element. Any one of the animal logo is displayed by utilizing a random number function incorporated in the apparatus, and the user is caused to input the English notation of the animal logo. In the case of a right answer, the next animal logo is displayed. In the case of a wrong answer, the user is caused to form the label in which the animal logo and the English notation are printed. When the teaching function is utilized, not only the foreign language vocabulary can be taught to children, but also the expression (in the predetermined language) of the public mark in Japan or other countries can be taught to children.

The utilization of the external ROM pack (or other storage mediums) can be also cited as an example of the modifications in the third and fourth embodiments. For example, even if the tape printing apparatus is formed by the dedicated machine, it is possible that the number of logos and the number of languages for producing the logo/character string label are increased by applying the external ROM pack.

What is claimed is:

1. A computer readable medium having a small print producing apparatus for printing a combination of a logo and a character string on a print medium, the small print producing apparatus comprising:

a first storage means for containing a plurality of logos;

second storage means for storing a plurality of records, each record including pieces of information in a plurality of types of fields including fields of at least two types of languages;

layout capturing means for specifying a layout of print elements in which a logo and a character string are combined together;

print element capturing means for specifying one logo as a print element from among the plurality of logos contained in the first storage means, for specifying at least one record from the plurality of records contained in the second storage means, and for specifying at least one of the pieces of information within the at least one specified record as print elements of the character string; and printing means for printing the print elements specified by the print element capturing means to produce the combination of the specified logo and the character string as small print in accordance with the layout specified by the layout capturing means.

2. A small print producing apparatus according to claim 1, wherein the printing means simultaneously prints attention information which is related to the language type field printed in small print and which indicates the type of language.

3. A small print producing apparatus according to claim 1, wherein a candidate for each print element captured by the print element capturing means is prepared as a layout candidate specified by the layout capturing means.

4. A small print producing method for printing a combination of a logo and a character string on a print medium, the small print producing method comprising:

prestoring, in first storage means for storing information, on-a plurality of logos and, in second storage means for storing information, a plurality of records, each record including pieces of information in a plurality of types of fields including fields of at least two types of languages;

specifying a layout of print elements in which a logo and a character string are combined together;

specifying one logo as a print element from among the plurality of logo prestored in the first storage means;

specifying at least one record from the plurality of records stored in the second storage means; and specifying at least one of the pieces of information within the at least one specified record as print elements of the character string; and printing the specified print elements to produce the combination of the specified logo and the character string as small print in accordance with the specified layout.

5. A small print producing method according to claim 4, further comprising, simultaneously with the printing of the specified print elements, printing attention information which is related to the language type field printed in small print and which indicates the type of language.

6. A small print producing method according to claim 4, further comprising combining a candidate for each specified print element as a layout candidate.

7. A small print producing program for printing a combination of a logo and a character string as small print, the program comprising:

a step of prestoring, in first storage means for storing information, a plurality of logos and in second storage means for storing information, a plurality of records, each record including pieces of information in a plurality of types of fields including fields of at least two types of languages;

a step of specifying a layout of print elements in which a logo and a character string are combined together;

a step of specifying one logo as a print element from the plurality of logos stored in the first storage means;

a step of specifying at least one record from the plurality of records stored in the second storage means; and a step of specifying at least one of the pieces of information within the at least one specified record as print elements of the character string; and a printing step for printing the specified print elements to produce the combination of the specified logo and the character string as small print in accordance with the specified layout.

8. A small print producing program in accordance with claim 7 encoded in computer readable form in an information storage medium.

* * * * *

UNITED STATES PATENT AND TRADEMARK OFFICE

CERTIFICATE OF CORRECTION

PATENT NO. : 7,195,409 B2
APPLICATION NO. : 10/917442
DATED : March 27, 2007
INVENTOR(S) : Horii et al.

It is certified that error appears in the above-identified patent and that said Letters Patent is hereby corrected as shown below:

Column 29, line 34 (claim 4, line 5), “on-a” should read -- on a --; and

Column 29, line 42 (claim 4, line 13), “logo” should read -- logos --.

Signed and Sealed this

Fourteenth Day of August, 2007

JON W. DUDAS
*Director of the United States Patent and Trademark Office*